US008468751B2

(12) United States Patent
Williams

(10) Patent No.: US 8,468,751 B2
(45) Date of Patent: Jun. 25, 2013

(54) METHOD OF STOWING AND DEPLOYING WALL PANELS

(75) Inventor: Charles Williams, Janesville, WI (US)

(73) Assignee: Hufcor, Inc., Janesville, WI (US)

( * ) Notice: Subject to any disclaimer, the term of this patent is extended or adjusted under 35 U.S.C. 154(b) by 116 days.

(21) Appl. No.: 13/107,496

(22) Filed: May 13, 2011

(65) Prior Publication Data

US 2012/0285090 A1 Nov. 15, 2012

(51) Int. Cl.
*E06B 9/26* (2006.01)
*E04H 12/18* (2006.01)

(52) U.S. Cl.
USPC ..... 52/71; 52/64; 160/36; 160/201

(58) Field of Classification Search
USPC ..... 52/64–72, 455–458, 202–203; 160/181, 160/188, 194, 196.1, 200, 201, 205, 36, 32
See application file for complete search history.

(56) References Cited

U.S. PATENT DOCUMENTS

| | | | | |
|---|---|---|---|---|
| 4,662,420 | A * | 5/1987 | Hirao | 160/32 |
| 4,807,685 | A | 2/1989 | Losch | |
| 4,986,331 | A * | 1/1991 | Henkenjohann | 160/201 |
| 5,065,806 | A * | 11/1991 | Kondoh | 160/36 |
| 5,072,766 | A * | 12/1991 | Kondoh et al. | 160/36 |
| 5,133,398 | A * | 7/1992 | Yang et al. | 160/33 |
| 5,172,742 | A * | 12/1992 | Iwasaki et al. | 160/36 |
| 5,584,331 | A * | 12/1996 | Lin | 160/172 R |
| 5,685,355 | A * | 11/1997 | Cook et al. | 160/202 |
| 6,339,905 | B1 * | 1/2002 | Craig | 52/174 |
| 6,651,724 | B1 * | 11/2003 | Cittadini | 160/207 |
| 6,868,891 | B2 * | 3/2005 | Cohen-Ravid et al. | 160/32 |
| 7,950,438 | B2 * | 5/2011 | Albert | 160/201 |
| 2005/0126721 | A1 * | 6/2005 | Fan | 160/201 |

FOREIGN PATENT DOCUMENTS

| | | |
|---|---|---|
| DE | 19505999 | 8/1996 |
| DE | 9421755 | 9/1996 |
| DE | 102006058864 | 6/2007 |
| WO | 9626342 | 8/1996 |
| WO | 9807946 | 2/1998 |

OTHER PUBLICATIONS

Loschwand, 2001, 3 pages, available at least as early as Sep. 6, 2011.

(Continued)

*Primary Examiner* — Brian Glessner
*Assistant Examiner* — Beth Stephan
(74) *Attorney, Agent, or Firm* — Michael Best & Friedrich LLP

(57) ABSTRACT

A method of moving panels from a stowed position to a deployed position includes supporting a first panel on a cam, rotating the cam in a first direction and lowering the first panel which separates the first panel from the cam and supports the first panel on a flexible lift member. Supporting a second panel on a support rack, biasing the second panel into engagement with the cam, rotating the cam in the first direction to transfer the second panel from the support rack to the cam. Further rotating the cam in the first direction, lowering the second panel to transfer the second panel from the cam to the first panel, so that the flexible lift member bears the weight of the first and second panels through the connection between the first panel and the flexible lift member. Fixing the first and second panels through a tongue and groove engagement.

20 Claims, 22 Drawing Sheets

OTHER PUBLICATIONS

Loschwand, HubWand, Counter, 4 pages, available at least as early as Sep. 6, 2011.

Loschwand, Classic, GG/2-298, 8 pages, available at least as early as Sep. 6, 2011.

Loschwand, Classic, GG/2-398, 3 pages., available at least as early as Sep. 6, 2011.

Loschwand, Classic, GG/2-398 TLS, 4 pages, available at least as early as Sep. 6, 2011.

Loschwand, Classic, GG/2-500, 3 pages, available at least as early as Sep. 6, 2011.

Loschwand, Classic, S 30/0, 1 page, available at least as early as Sep. 6, 2011.

Loschwand, Classic, S 67/0+ S 67/SD, 2 pages, available at least as early as Sep. 6, 2011.

Crown Industries Inc., 14×12 Hydraulic Bi-Fold, 1 page, available at least as early as Apr. 1, 2011.

PCT/US2011/036477 International Search Report and Written Opinion dated Jan. 25, 2012 (11 pages).

* cited by examiner

METHOD OF STOWING AND DEPLOYING WALL PANELS

BACKGROUND

The present invention relates to walls that are moveable between a stowed position and a deployed position.

SUMMARY

In one embodiment, the invention provides a method of moving panels from a stowed position, in which the panels are substantially positioned above a ceiling, to a deployed position, in which the panels are substantially vertically aligned to form a wall. The method includes supporting a first panel having a first weight on a cam, rotating the cam in a first direction and lowering the first panel in response to rotation of the cam. Lowering the first panel separates the first panel from the cam. Supporting the first panel on a flexible lift member in response to lowering the first panel, so that the flexible lift member bears the first weight. Supporting a second panel having a second weight on a support rack, and biasing the second panel into engagement with the cam. The method further includes rotating the cam in the first direction and transferring the second panel from the support rack to the cam in response to rotating the cam, so that the cam bears the second weight. The method further includes further rotating the cam in the first direction, lowering the second panel in response to further rotation of the cam and transferring the second panel from the cam to the first panel, so that the first panel bears the second weight, and the flexible lift member bears the first weight and the second weight through the connection between the first panel and the flexible lift member. The method further includes fixing the second panel to the first panel through a mating tongue and groove engagement.

In another embodiment, the invention provides a method of moving panels from a deployed position, in which the panels are substantially vertically aligned to form a wall, to a stowed position, in which the panels are substantially positioned above a ceiling. The method includes supporting a first panel having a first weight on a flexible lift member, so that the flexible lift member bears the first weight, supporting a second panel having a second weight on the first panel, so that the flexible lift member bears the first weight and the second weight through the connection between the first panel and the flexible lift member. The method further includes moving the first and second panels substantially vertically and lifting the second panel off of the first panel with a cam, so that the cam bears the second weight, disengaging the second panel from the first panel by vertically displacing the second panel from the first panel. The method further includes transferring the second panel from the cam to a support rack, so that the support rack bears the second weight and displacing the second panel horizontally from the first panel by transferring the second panel onto the support rack. The method further includes further moving the first panel substantially vertically, lifting the first panel with the cam, and rotating the cam so that the cam bears the first weight.

In still another embodiment, the invention provides a wall panel assembly moveable between a stowed position and a deployed position. The wall panel assembly includes a first wall panel having a first weight and including a first carrier, a flexible lift member coupled to the first wall panel and a second wall panel having a second weight and including a second carrier. A prime mover moves the first and second wall panels between the stowed position and the deployed position. A support rack supports the second carrier and bears the second weight when the second wall panel is in the stowed position, and the flexible lift member bears the second weight when the second wall panel is in the deployed position through the connection between the first wall panel and the flexible lift member. A cam has an exterior perimeter that defines a recess sized to receive at least one of the first and second carriers. The cam rotates in response to the prime mover. Rotation of the cam in a first direction moves the first and second wall panels into the deployed position, and rotation of the cam in a second direction, opposite the first direction, moves the first and second wall panels into the stowed position.

Other aspects of the invention will become apparent by consideration of the detailed description and accompanying drawings.

DETAILED DESCRIPTION

Before any embodiments of the invention are explained in detail, it is to be understood that the invention is not limited in its application to the details of construction and the arrangement of components set forth in the following description or illustrated in the following drawings. The invention is capable of other embodiments and of being practiced or of being carried out in various ways. Also, it is to be understood that the phraseology and terminology used herein is for the purpose of description and should not be regarded as limiting. The use of "including," "comprising," or "having" and variations thereof herein is meant to encompass the items listed thereafter and equivalents thereof as well as additional items. Unless specified or limited otherwise, the terms "mounted," "connected," "supported," and "coupled" and variations thereof are used broadly and encompass both direct and indirect mountings, connections, supports, and couplings. Further, "connected" and "coupled" are not restricted to physical or mechanical connections or couplings.

Figure 1:
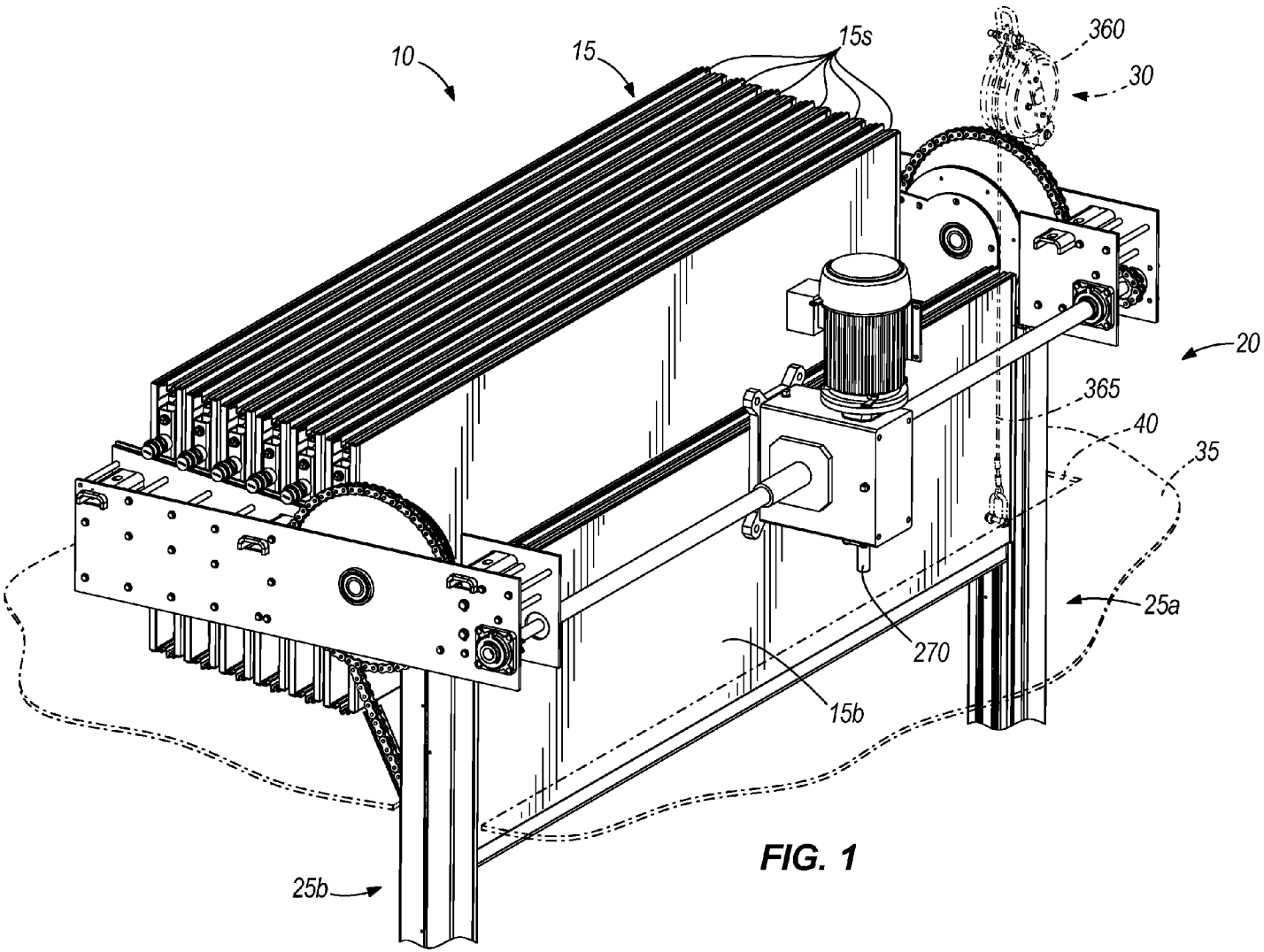
FIG. 1 is a perspective view of a wall panel assembly according to some embodiments of the present invention.

FIG. 1 illustrates a wall panel assembly 10 including a plurality of wall panels 15, a drive assembly 20, first and second jamb assemblies 25*a*, 25*b*, and a cable device 30. The illustrated wall panel assembly 10 includes seven separate wall panels 15, but other quantities of wall panels 15 can be utilized. The illustrated plurality of wall panels 15 include a plurality of stowable panels 15*s* and a bottom panel 15*b*. The illustrated embodiment includes six stowable panels 15*s* and one bottom panel 15*b*.

A ceiling 35 having an opening 40 is illustrated in phantom in FIG. 1. The wall panel assembly 10 is positioned above the ceiling 35 to substantially hide the wall panel assembly 10 from view when stowed. The wall panels 15 move through the opening 40 to deploy and the illustrated first and second jamb assemblies 25*a*, 25*b* extend through the opening 40.

Figure 2:
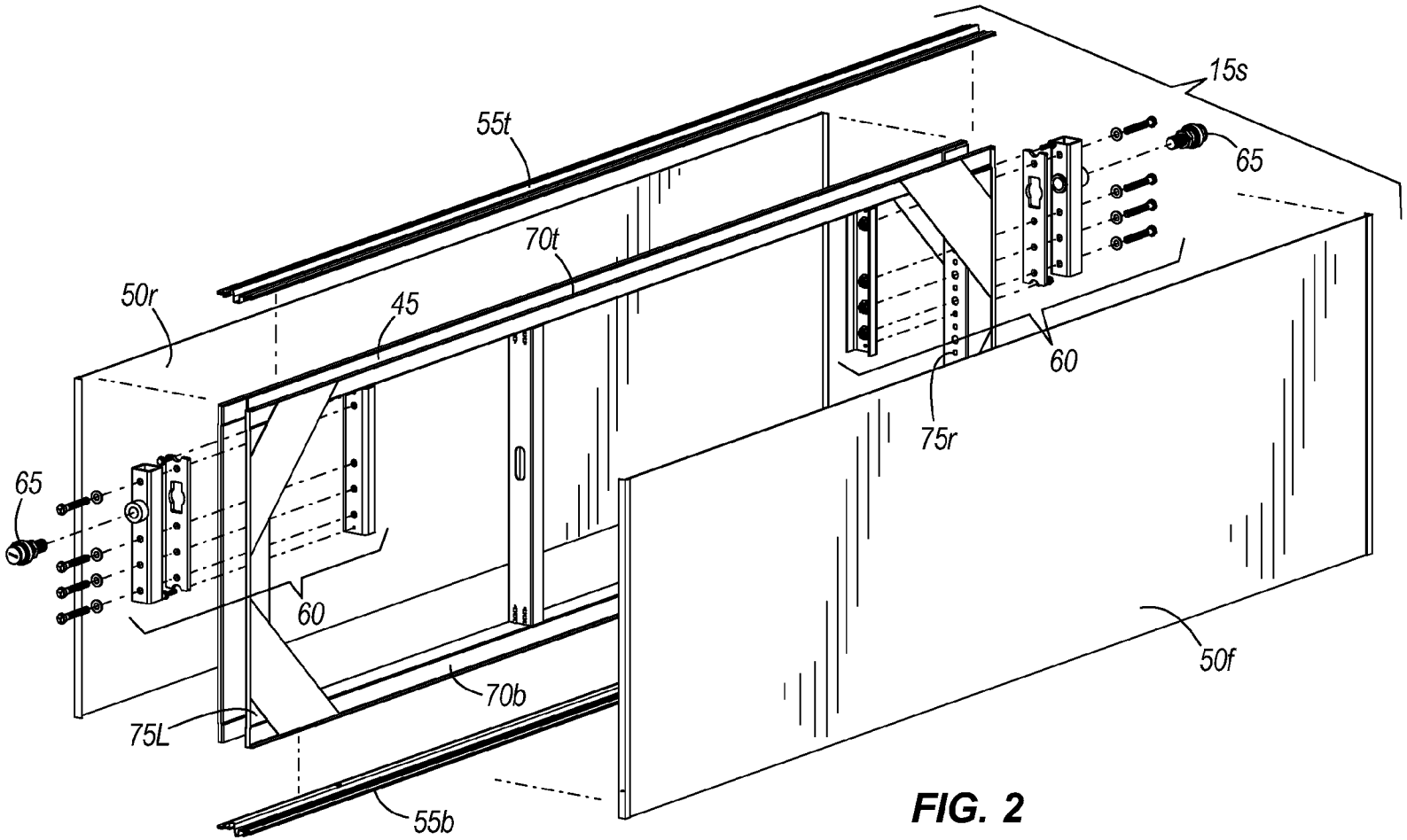
FIG. 2 is an exploded perspective view of one of the panels of the wall panel assembly.

FIG. 2 illustrates one of the stowable panels 15*s* in detail. The stowable panels 15*s* are substantially identical, so the discussion of the stowable panel of FIG. 2 applies to all six of the illustrated stowable panels 15*s*. The illustrated stowable panel 15*s* includes a frame 45, front and rear panel faces 50*f*, 50*r*, top and bottom dovetail pieces 55*t*, 55*b*, carrier mounting brackets 60 and carriers 65. The frame 45 defines top and bottom support brackets 70*t*, 70*b* and left and right support brackets 75*l*, 75*r*. The top and bottom and left and right support brackets 70*t*, 70*b*, 75*l*, 75*r* connect to form the frame 45. The front and rear panel faces 50*f*, 50*r* are coupled to the frame 45 to provide first and second oppositely-facing wall surfaces. The illustrated stowable panel 15*s* is substantially cuboid in shape. The top and bottom dovetail pieces 55*t*, 55*b* are mounted on the top and bottom support brackets 70*t*, 70*b*, respectively.

Figure 3:
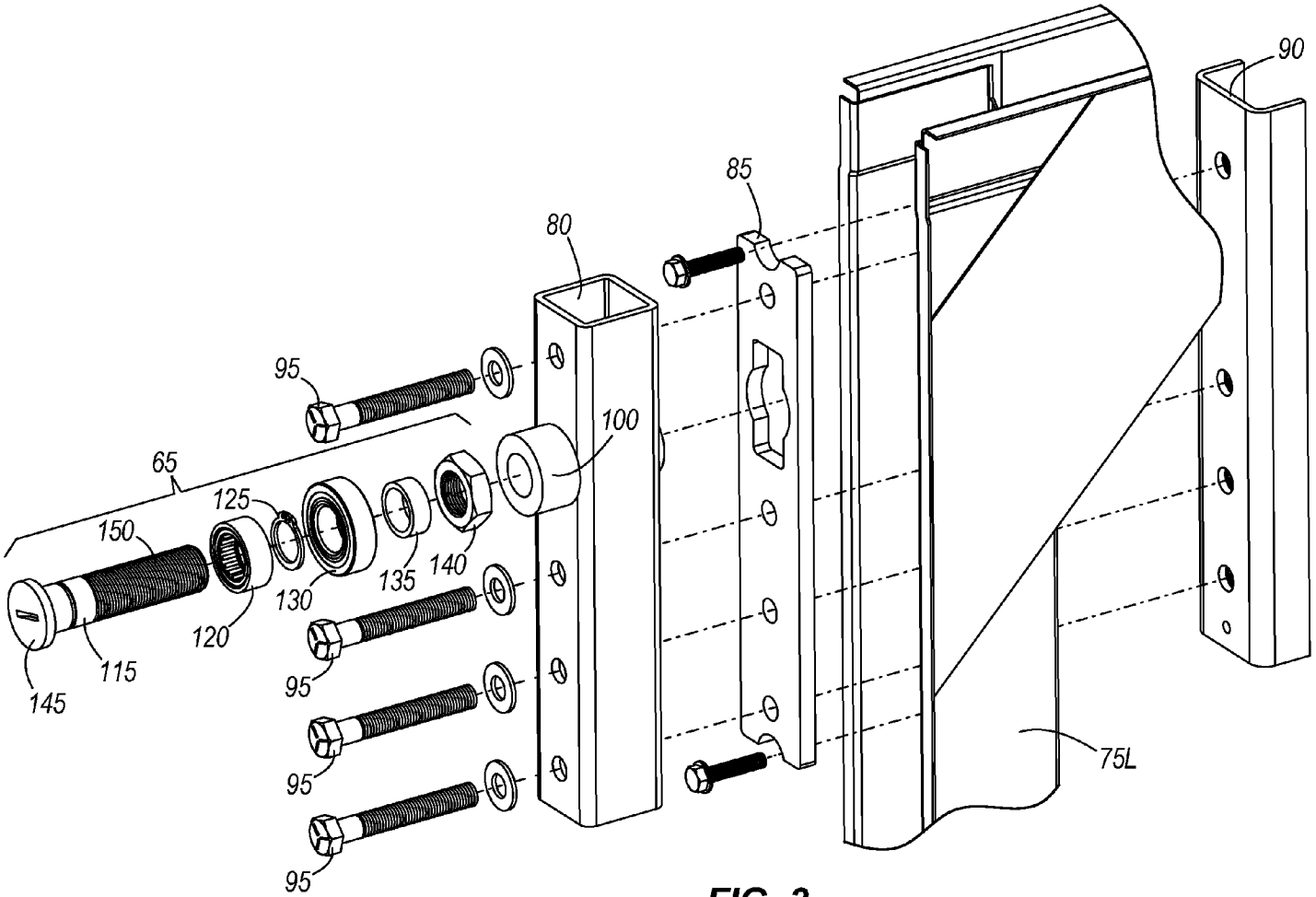
FIG. 3 is an exploded perspective view of a carrier and a carrier mounting bracket.

The carrier mounting brackets 60 are coupled to the left and right support brackets 75*l*, 75*r*, respectively. FIG. 3 illustrates one carrier mounting bracket 60 and one carrier 65 in greater detail. The illustrated carrier mounting bracket 60 includes a hollow tube 80, a first plate 85, a second plate 90, a plurality of fasteners 95 and a carrier retaining sleeve 100. The illustrated hollow tube 80 has a substantially square cross section. The hollow tube 80 and the first plate 85 are positioned on an outside surface of the left support bracket 75*l* and the second plate 90 is positioned on a inside surface of the right support bracket 75*r*. The plurality of fasteners 95 extend through respective apertures in the hollow tube 80, the first plate 85, the right support bracket 75*r* and the second plate 90 to connect the carrier mounting bracket 60 to the frame 45. In the illustrated embodiment, the carrier retaining sleeve 100 is permanently affixed to the hollow tube 85, extends through an aperture in the first plate 85, and abuts the left support bracket 75*l*. The carrier retaining sleeve 100 is hollow and is internally threaded. In the illustrated embodiment, one of the fasteners 95 is positioned above and three of the fasteners 95 are positioned below the carrier retaining sleeve 100. Other quantities, locations and configurations of apertures are possible.

The carrier 65 includes a fastener 115, a first bearing 120, a snap ring 125, a second bearing 130, a bearing retaining sleeve 135, and a nut 140. The fastener 115 may be a shoulder bolt and includes a head 145 and a shaft 150. The head 145 has a larger diameter than the shaft 150. The illustrated head 145 is round and includes a slot to receive a tool to tighten and loosen the fastener 115. The illustrated shaft 150 includes a threaded portion that is threaded into the carrier retaining sleeve 100. A distance between the head 145 and the carrier retaining sleeve 100 is adjustable by threading or unthreading the fastener 115 from the carrier retaining sleeve 100. The first bearing 120 is positioned on the fastener 115 in abutment with the head 145. The illustrated first bearing 120 is a needle bearing, but another suitable bearing or bushing can be utilized. The snap ring 125 is positioned adjacent the first bearing 120. In the illustrated embodiment, the shaft 150 defines a groove to receive the snap ring 125 therein. The snap ring 125 is operable to retain the first bearing 120 in abutment with the head 145. In another embodiment, a detent or other structural protuberance is utilized the retain the first bearing 120 in abutment with the head 145.

The second bearing 130 is positioned adjacent the snap ring 125. The illustrated second bearing 130 is a roller bearing, but another suitable bearing or bushing can be utilized. The bearing retaining sleeve 135 is positioned adjacent the second bearing 130. In some embodiments, the bearing retaining sleeve 135 is threaded onto the fastener 115 to retain the second bearing 130 in position on the fastener 115. In the illustrated embodiment, a nut 140 or other structural element is utilized to retain the second bearing 130 in abutment with the snap ring 125. The nut 140 is threaded onto the fastener 115 and is spaced from the bearing retaining sleeve 135 in the illustrated embodiment. The illustrated nut 140 abuts the carrier retaining sleeve 100. The nut 140 permits adjustment of a distance between the head 145 and the carrier retaining sleeve 100. The nut 140 performs the function of a lock nut against the carrier retaining sleeve 100. Other distance adjustment configurations are possible and the illustrated nut 140 and carrier retaining sleeve 100 are given by way of example only.

Figure 4:
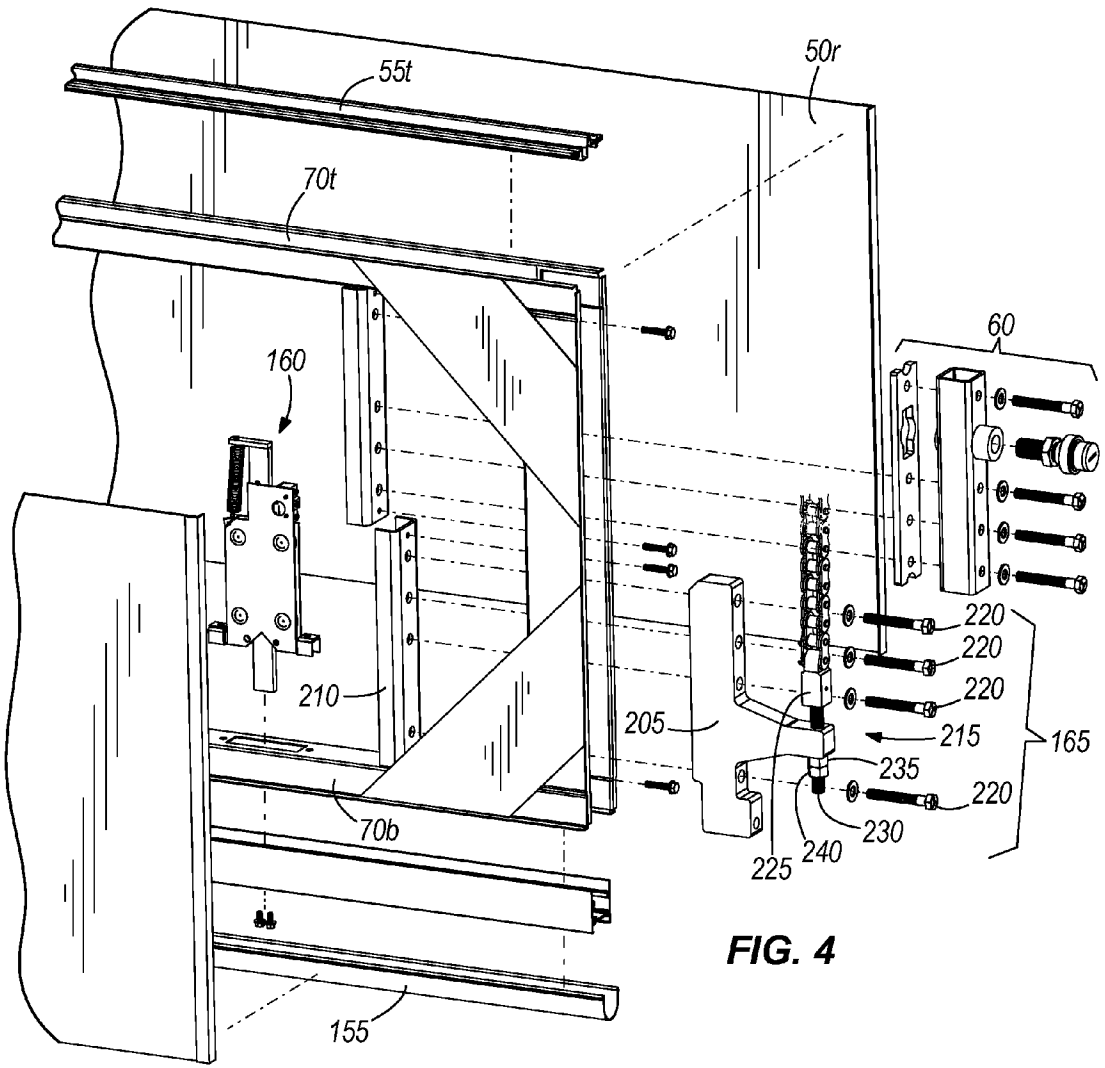
FIG. 4 is an exploded perspective view of another one of the panels of the wall panel assembly.

With reference to FIG. 4, the bottom panel 15*b* includes many of the same features as the stowable panels 15*s*; only the features specific to the bottom panel 15*b* are discussed herein. The bottom panel 15*b* includes a bottom seal 155, an object present sensor assembly 160 and a chain mount 165. The seal 155 is coupled directly to the bottom support bracket 70*b*; the bottom panel 15*b* has no bottom dovetail piece 55*b*. The seal 155 is flexible and extends downwardly in a substantially arcuate configuration.

Figure 5:
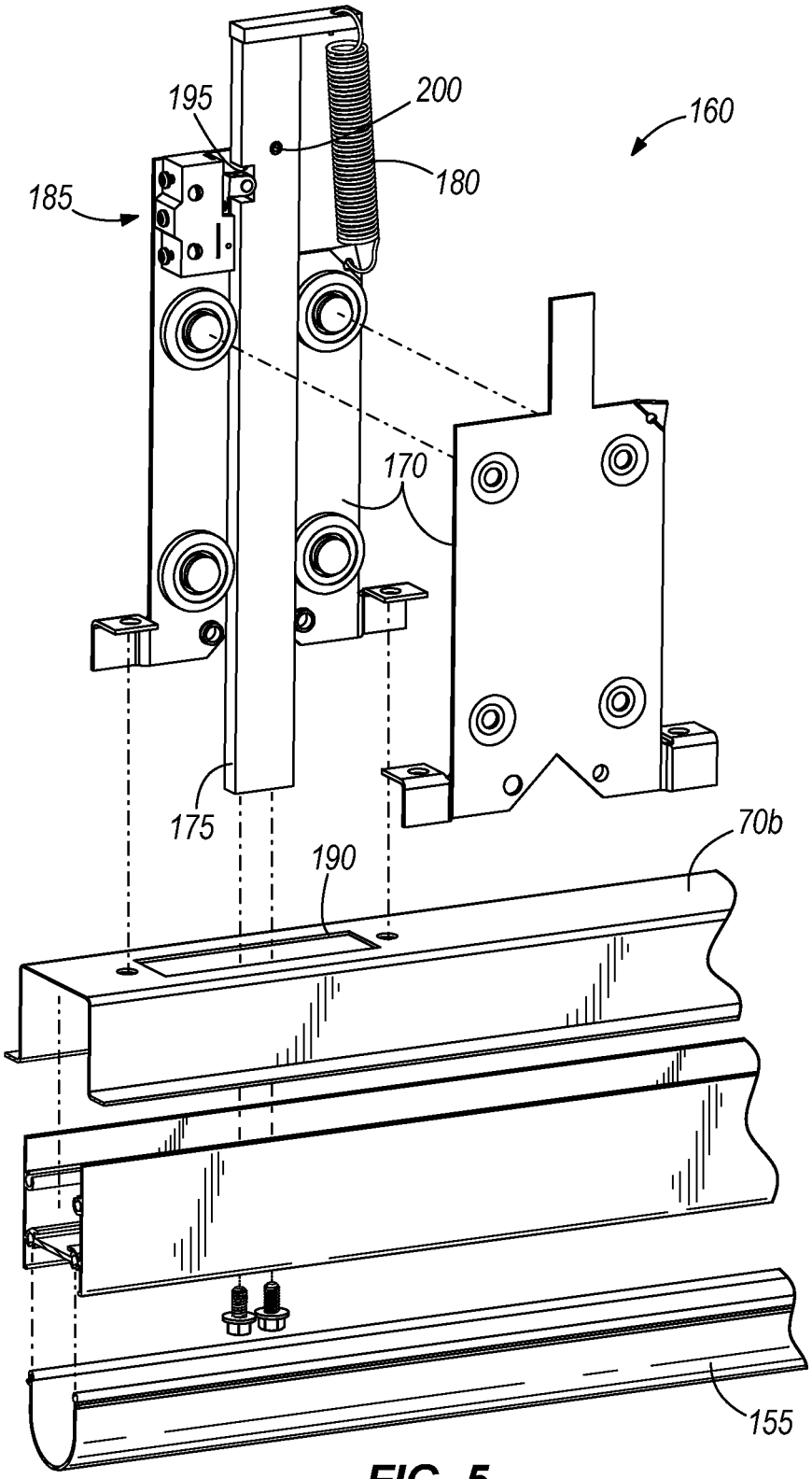
FIG. 5 exploded view of an object presence sensor of FIG. 4.

With reference to FIG. 5, the object presence sensor assembly 160 includes a main body 170, an arm 175, a spring 180 and a circuit element 185. The main body 170 is mounted to the bottom support bracket 70*b* and extends through an aperture 190 in the bottom support bracket 70*b*. The arm 175 is coupled to the main body 170 and extends substantially vertically and downward through the aperture 190 in the bottom support bracket 70*b*. The illustrated arm 175 includes a recess 195 and a pin 200. The illustrated main body 170 abuts the pin 200, and the arm 175 substantially abuts the seal. The spring 180 is coupled to the main body 170 and the arm 175 and retains the arm 175 in a first, un-actuated position. The illustrated circuit element 185 is a switch including a first moveable portion and a second portion. The switch second portion is mounted to the main body 170 and the first moveable portion is free to move with respect to the main body 170. When in the first, un-actuated position, the first moveable portion is spaced from the recess 195. In the second, actuated position, the first moveable portion contacts the recess 195. When actuated, the object presence sensor assembly 160 opens a circuit to stop operation of the drive assembly 20. When the seal 155 abuts an object, such as an obstruction or the floor, the arm 175 is biased upward to actuate the object presence sensor assembly 160 and therefore, stop operation of the drive assembly 20.

With reference to FIG. 4, the chain mount 165 includes an elongate bracket 205 having an arm, a second bracket 210 and an adjustable connector assembly 215. The elongate bracket 205 is connected to the right support bracket 75*r* by a plurality of fasteners 220. In another embodiment, the elongate bracket 205 includes an extension that is connected to the bottom support bracket 70*b* in addition to or in lieu of the elongate bracket 205 being connected to the right support bracket 75*r*. The arm projects substantially normal to the right support bracket 75*r*. The arm includes an aperture extending vertically therethrough. The adjustable connector assembly 215 includes an anchor 225, a stud 230, a nut 235 and a lock nut 240. The anchor 225 includes a first aperture oriented along a substantially horizontal axis and a second aperture oriented along a substantially vertical axis. The second aperture 240 is threaded in the illustrated embodiment. The stud 230 is threaded and extends through the arm aperture and into the vertical anchor aperture. The nut 235 and lock nut 240 thread onto the stud 230 below the arm. The nut 235 and lock nut 240 are operable to couple the stud 230 to the arm. A distance between the arm and the anchor 225 is adjustable by adjusting the position of the nut 235 and the lock nut 240 on the stud 230.

Figure 6:
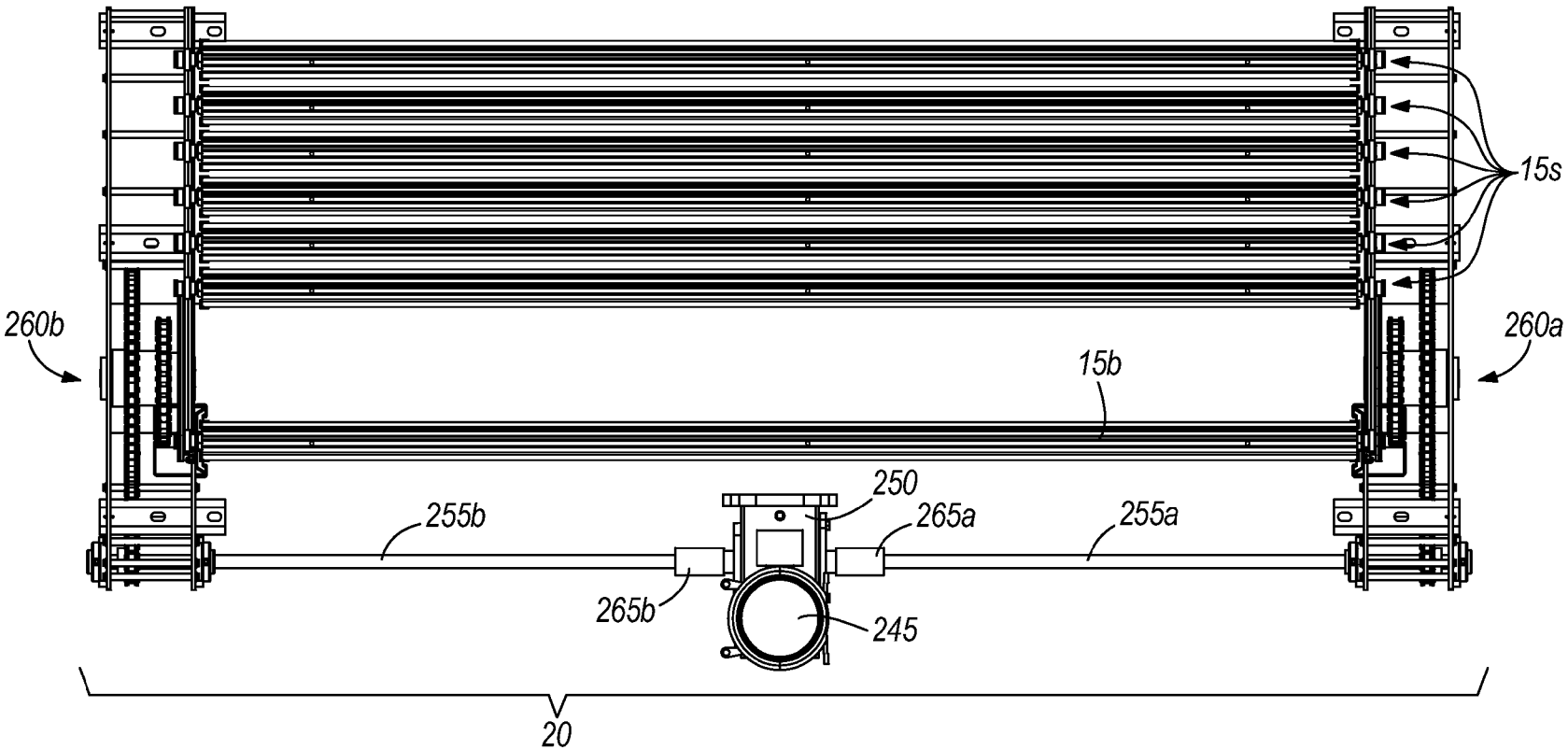
FIG. 6 is a top view of the wall panel assembly of FIG. 1.

With reference to FIG. 6, the drive assembly 20 includes a prime mover 245, a gear reducer 250, first and second output shafts 255*a*, 255*b* and first and second drive box assemblies 260*a*, 260*b*. The illustrated prime mover 245 is an electric motor, but in other embodiments, other suitable prime movers can be utilized. The illustrated gear reducer 250 includes one input coupled to the electric motor and first and second outputs 265*a*, 265*b*. The first and second outputs 265*a*, 265*b* are substantially co-linear and extend outwardly from the gear reducer 250. The first and second output shafts 255*a*, 255*b* are coupled to the respective first and second outputs 265*a*, 265*b* for rotation therewith. The first and second output shafts 255*a*, 255*b* extend toward and engage the respective first and second drive box assemblies 260*a*, 260*b*. The illustrated gear reducer 250 also includes a third output 270 (see FIG. 1) extending downward from the gear reducer 250. The third output 270 is engageable by a user for optional manual operation of the gear reducer 250. Although not specifically illustrated, the gear reducer 250 is mounted to the building structure.

Figure 7:
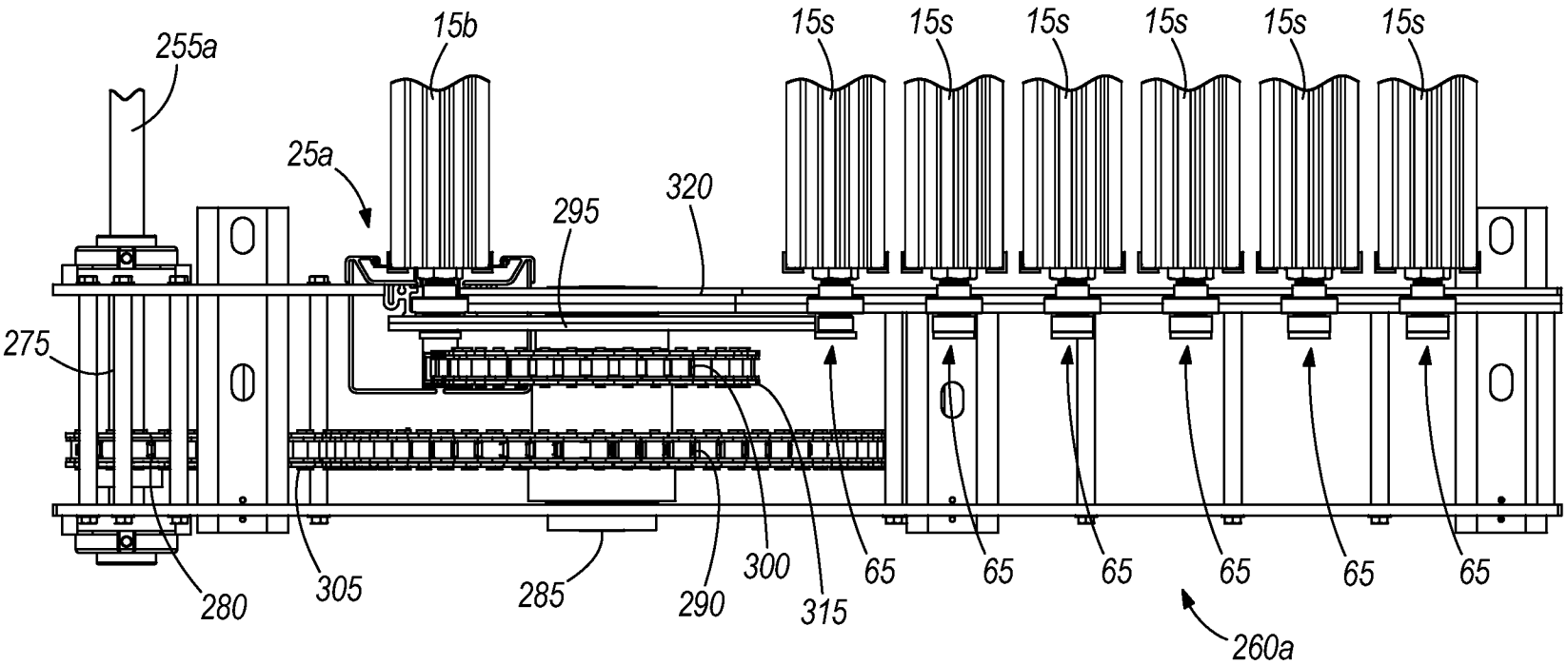
FIG. 7 is a top view of a drive box assembly according to some embodiments of the present invention.

The first and second drive box assemblies 260*a*, 260*b* are substantially mirror images, so only the first drive box assembly 260*a* will be discussed in detail. As shown in greater detail in FIGS. 7-9, the first second drive box assembly 260*a* includes a first drive shaft 275, a first sprocket 280, a second drive shaft 285, a second sprocket 290, a cam 295, a third sprocket 300, a first chain 305, an idler sprocket 310, a flexible lift member 315, a support rack 320 and a bar 322. The first drive shaft 275 is coupled to the first output shaft 255*a* for rotation therewith. The first sprocket 280 is coupled to the first drive shaft 275 for rotation therewith. The illustrated first sprocket 280 has ten teeth. The second drive shaft 285 is spaced from and substantially parallel to the first drive shaft 275. The second sprocket 290 is coupled to the second drive shaft 285 for rotation therewith. The illustrated second sprocket 290 has sixty teeth. The cam 295 is coupled to the second drive shaft 285 for rotation therewith. The illustrated cam 295 includes a substantially circular outer perimeter defining a first radius and a slot 325 which defines a second radius, smaller than the first radius. The slot 325 is sized to receive one of the carriers 65. The illustrated slot 325 is substantially symmetrical and includes a first substantially planar portion 325*a*, a second substantially planar portion 325*b* and a first recess portion 325*c* between the first and second substantially planar portions. The substantially planar portions 325*a*, 325*b* guide the carrier 65 into the recess portion 325*c* when the cam 295 rotates. The third sprocket 300 is coupled to the second drive shaft 285 for rotation therewith. The illustrated third sprocket 300 is positioned between the second sprocket 290 and the cam 295. The illustrated third sprocket 300 includes thirty teeth and has a one inch pitch.

The first chain 305 encircles the first sprocket 280 and the second sprocket 290 to couple the first sprocket 280 to the second sprocket 290. The first chain 305 connects the first drive shaft 275 and the second drive shaft 285, such that rotation of the first drive shaft 275 causes rotation of the second drive shaft 285. The idler sprocket 310 is also coupled to the first chain 305 and is utilized to adjust tension in the first chain 305. The first and second sprockets 280, 290 having different quantities of teeth to permit further reduction of rotation of the second drive shaft 285. In the illustrated embodiment, the first sprocket 280 completes six full rotations while the second sprocket 290 completes only one full rotation. Other quantities of teeth and varieties of gear reduction are possible, and the illustrated is given by way of example only.

The illustrated flexible lift member 315 is a length of chain (herein referred to as a second chain) but other flexible lift members, such as cables, ropes, cords, strings, and the like can be utilized in place of the illustrated second chain 315. The second chain 315 engages the third sprocket 300 and thereby moves in response to rotation of the second drive shaft 285. The second chain 315 is coupled to the bottom panel 15*b* via the adjustable connector assembly 215. Specifically, a cross link member of the second chain 315 extends through the first aperture 235 of the anchor 215.

Figure 8:
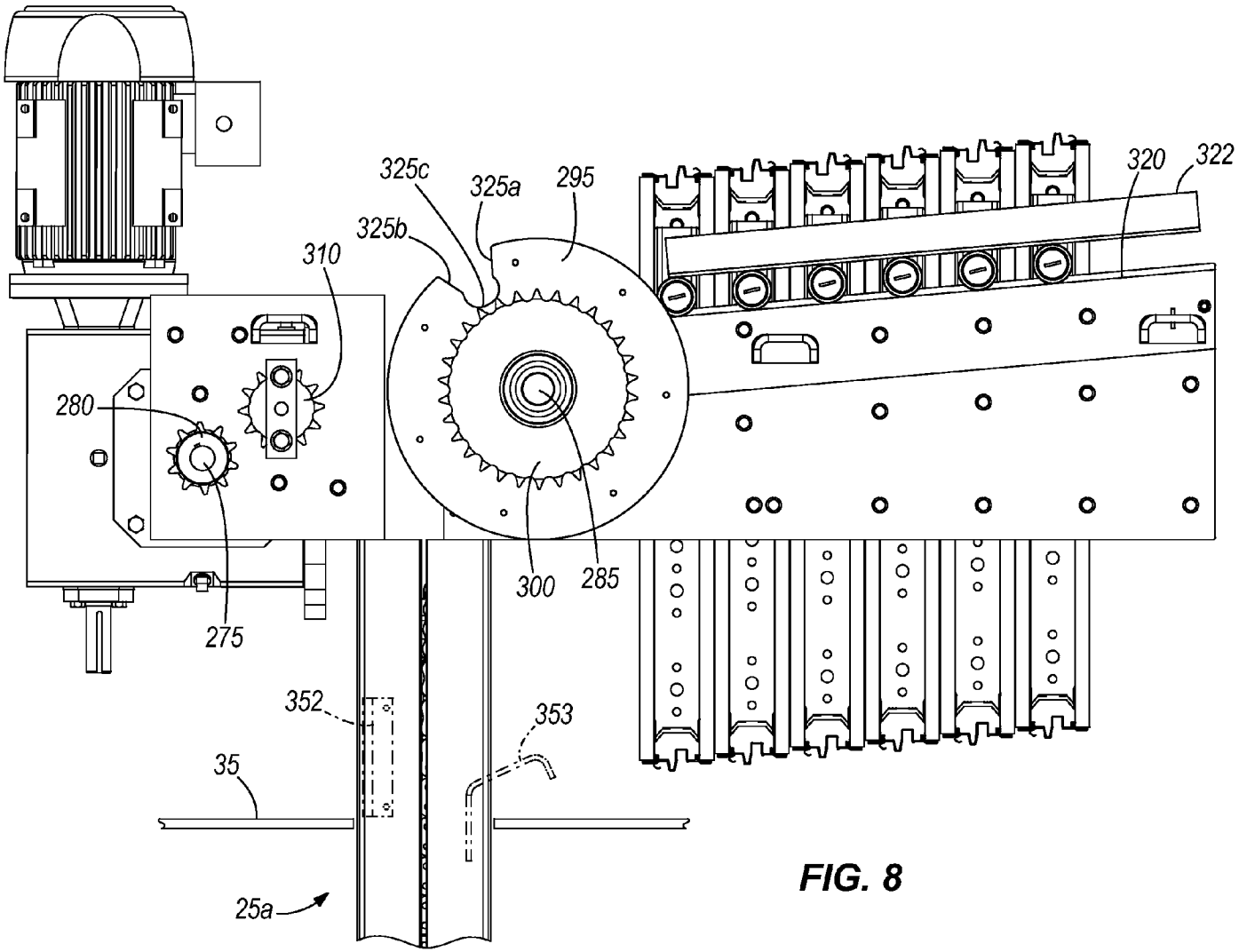
FIG. 8 is side view of the drive box assembly with parts removed for clarity.
Figure 9:
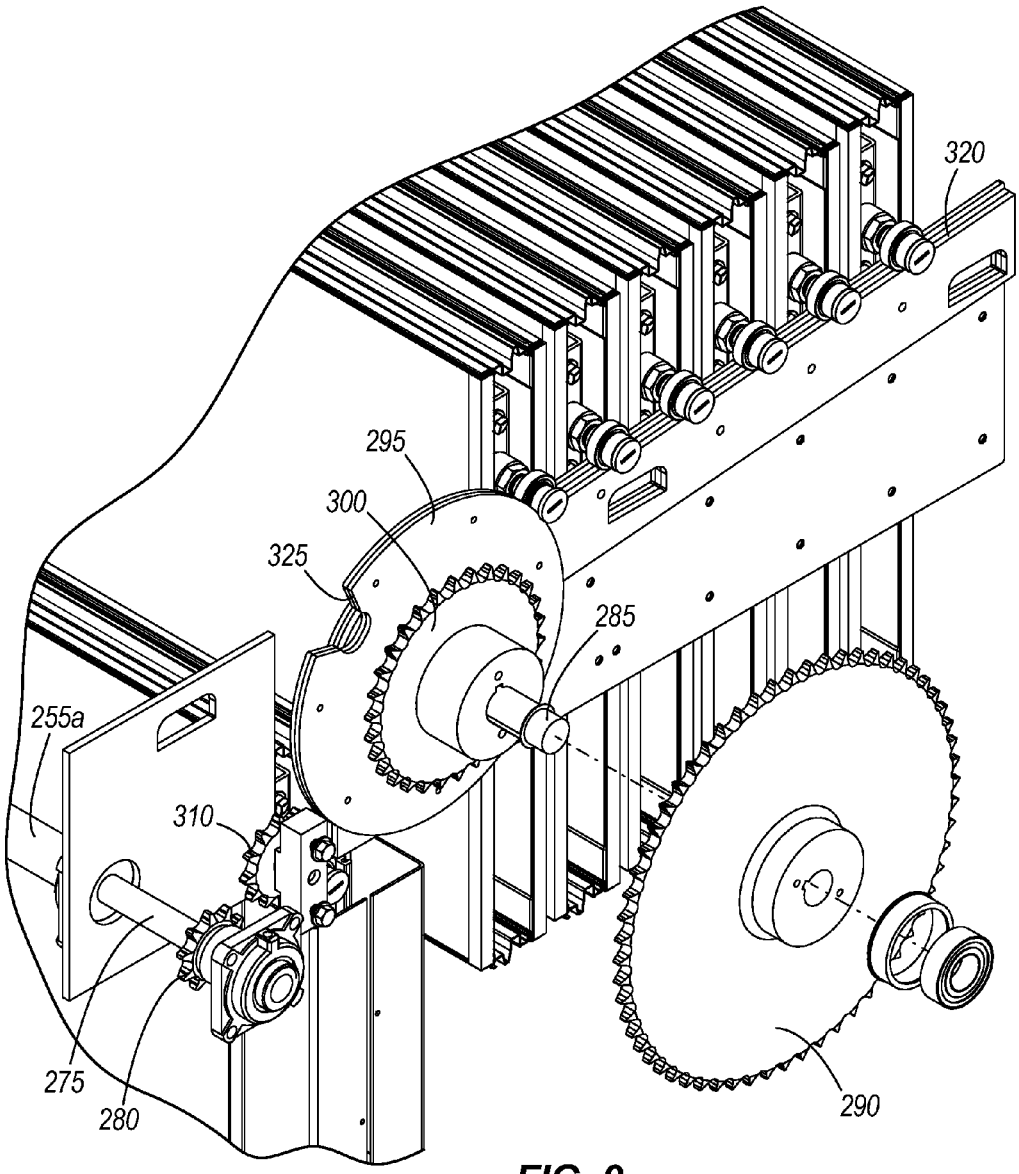
FIG. 9 is an exploded perspective view of the drive box assembly.

The illustrated support rack 320 is a vertically extending plate with an inclined upper edge. The inclined upper edge is sized to support the carriers 65. In the illustrated embodiment, the carrier second bearing 130 moves along the inclined upper edge. The inclined edge of the support rack 320 is angled downwardly toward the cam 295. Gravity is utilized to move the carriers 65 into engagement with the cam 295. In another embodiment, a separate motive force (in addition to gravity) is utilized to move the carriers 65 into engagement with the cam 295. In the illustrated embodiment, the incline is about 5 degrees, but other incline angles can be utilized. The bar 322 illustrated in FIG. 8 is positioned above the inclined support rack 320 and inhibits the carriers 65 from detaching from the inclined support rack 320. The bar 322 can assist in aligning the stowable panels 15*s* on the inclined support rack 320. The bar 322 is only illustrated in FIG. 8, but is omitted from the remaining figures for clarity.

Figure 10:
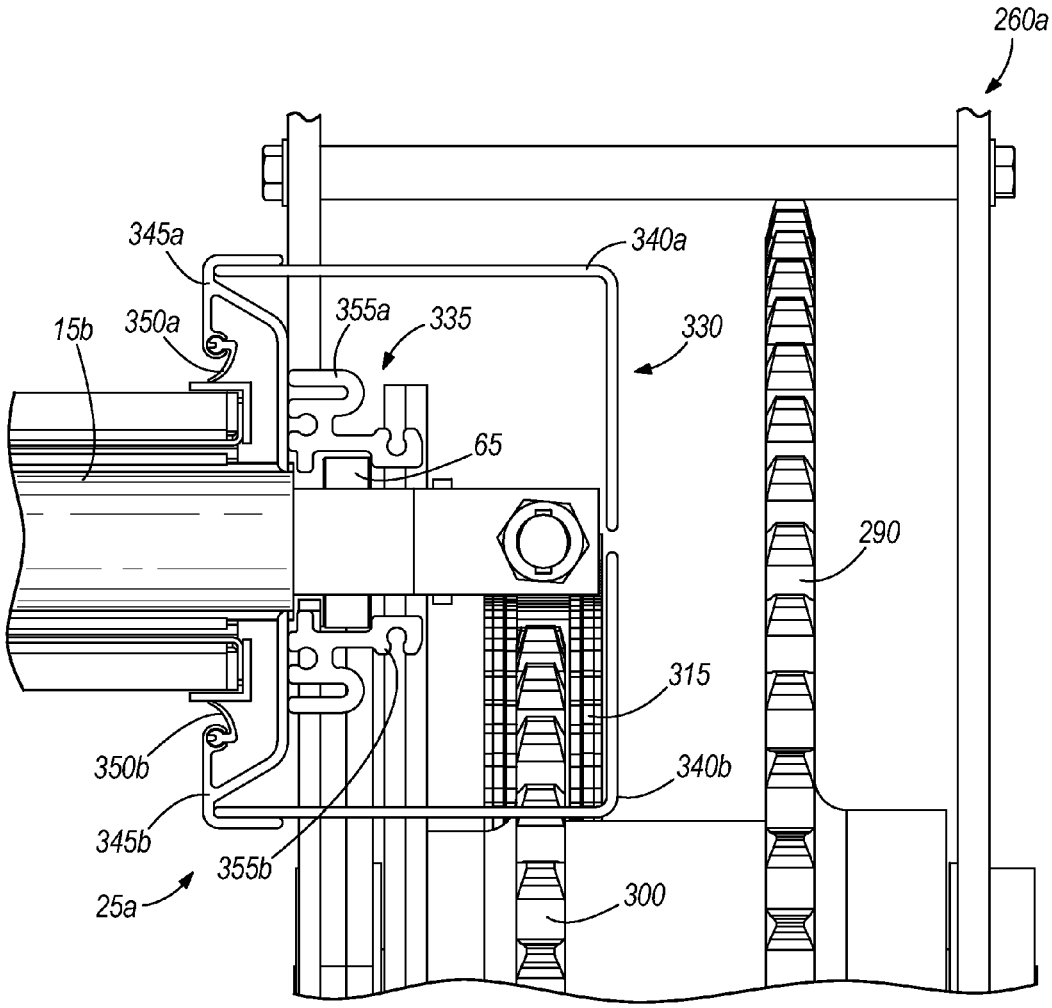
FIG. 10 is a top view of a jamb assembly.

With reference to FIG. 10, the first jamb assembly 25*a* includes an external housing assembly 330 and an internal guidance system 335. The first jamb assembly 25*a* and the second jamb assembly 25*b* are substantial mirror images, so only the first jamb assembly 25*a* is described in detail. The external housing assembly 330 is mounted to a floor and the first drive box assembly 260*a* and includes first and second L-shaped brackets 340*a*, 340*b*, first and second mounting brackets 345*a*, 345*b*, first and second gaskets 350*a*, 350*b* and first and second alignment brackets 352, 353. The first and second L-shaped brackets 340*a*, 340*b* define a structure substantially enclosed on three sides, thereby leaving one side substantially open. The illustrated first and second L-shaped brackets 340*a*, 340*b* are jamb receivers made from extruded aluminum. The illustrated first and second mounting brackets 345*a*, 345*b* are guide rails that extend across a portion of the open side. The first and second mounting brackets 345*a*, 345*b* extend inward into an interior of the structure. The first and second gaskets 350*a*, 350*b* extend inward from the first and second mounting brackets 345*a*, 345*b* across a portion of the open side. The first and second alignment brackets 352, 353 (see FIG. 8) engage and vertically align the panels 15 during stowage and deployment. The illustrated alignment brackets 352, 353 are shown by way of example only. Other configurations, shapes and quantities of alignment brackets can be utilized. In some embodiments, the alignment brackets are omitted. The external housing assembly 330 receives the second chain 315 extending therethrough. In some embodiments, the first jamb assembly 25*a* is mounted to a building wall and the external housing assembly 330 extends into a room in the building. In other embodiments, the first jamb assembly 25*a* is mounted to a building wall and the external housing assembly 330 is contained within the wall.

The internal guidance system 335 includes first and second guide brackets 355*a*, 355*b* coupled to respective first and second mounting brackets 345*a*, 345*b*. The first and second guide brackets 355*a*, 355*b* define a substantially vertical opening 40 sized to received the carriers 65 therein. The first and second guide brackets 355*a*, 355*b* substantially surround a portion of the carriers 65 to retain the panels in a substantially aligned orientation.

The cable device 30 (shown in FIG. 1) is a centrifugal cam 295 including a housing 360 and a cable 365. Although not specifically shown, one cable device 30 can be provided per drive box assembly 260*a*, 260*b*. The cable 365 is free to move with respect to the housing 360 at low speed, but the cable device 30 brakes at high speed. The housing 360 is coupled to the building or other structure and the cable 365 is coupled to the bottom panel 15*b*. In the event that the any component in the wall panel assembly 10 fails, the cable device(s) 30 support the bottom panel 15*b*, and thus, the remaining panels resting on the bottom panel 15*b*.

Figure 11:
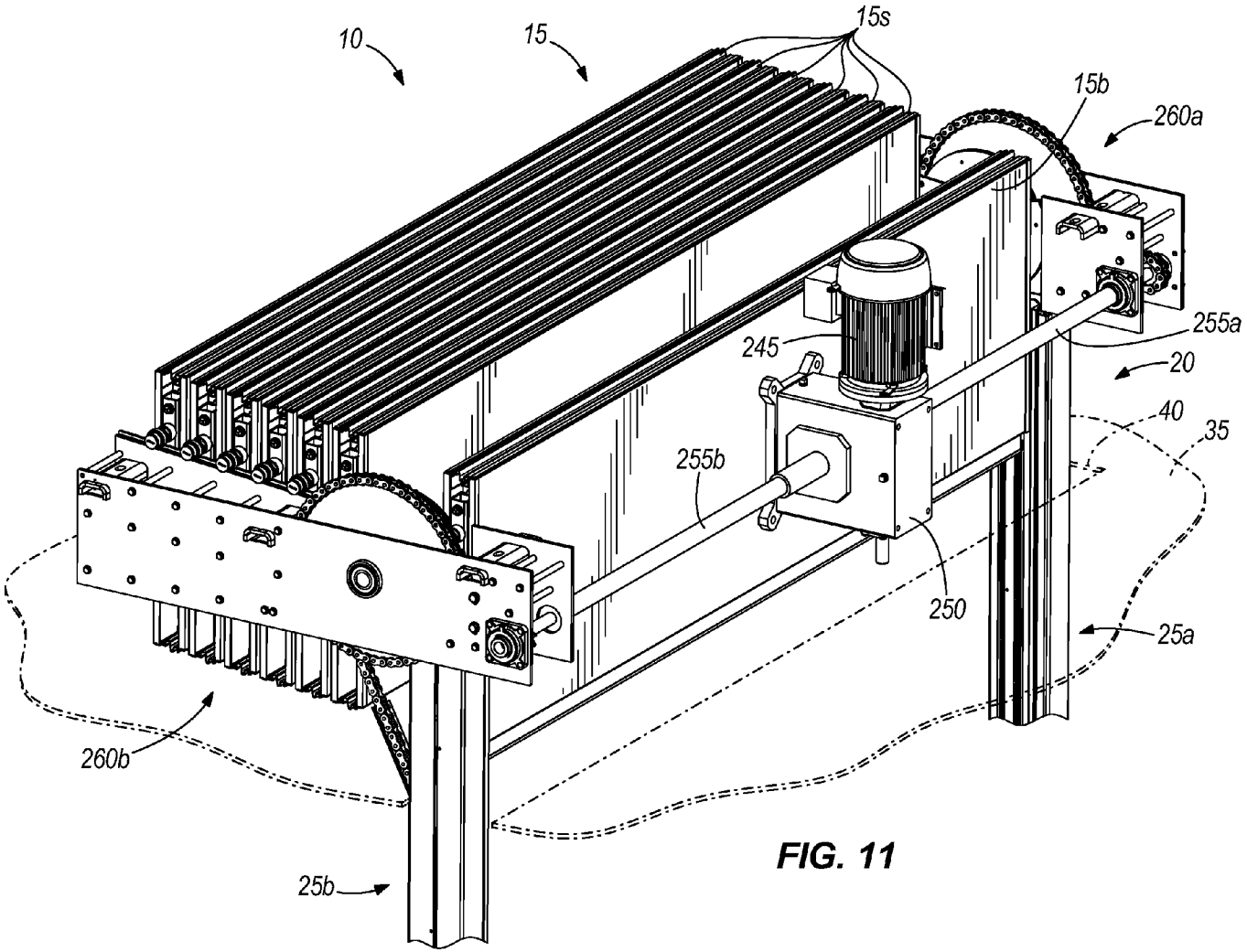
FIG. 11 perspective view of the panels in a stowed position.
Figure 17:
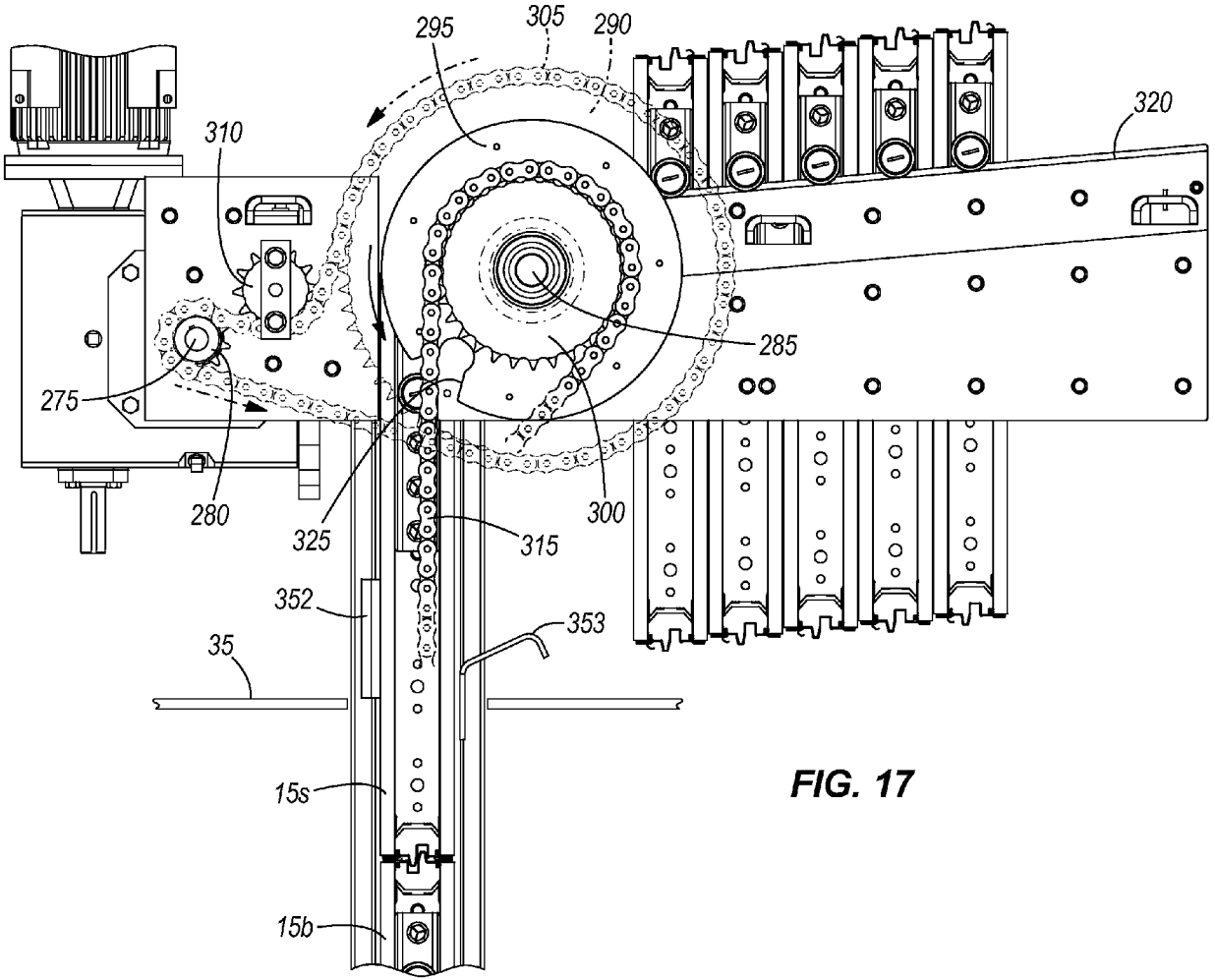
FIG. 17 is a side view illustrating the jamb vertically orienting the first stowable panel and the bottom panel, so that the dovetails of the panels mate when the cam releases first stowable panel.
Figure 18:
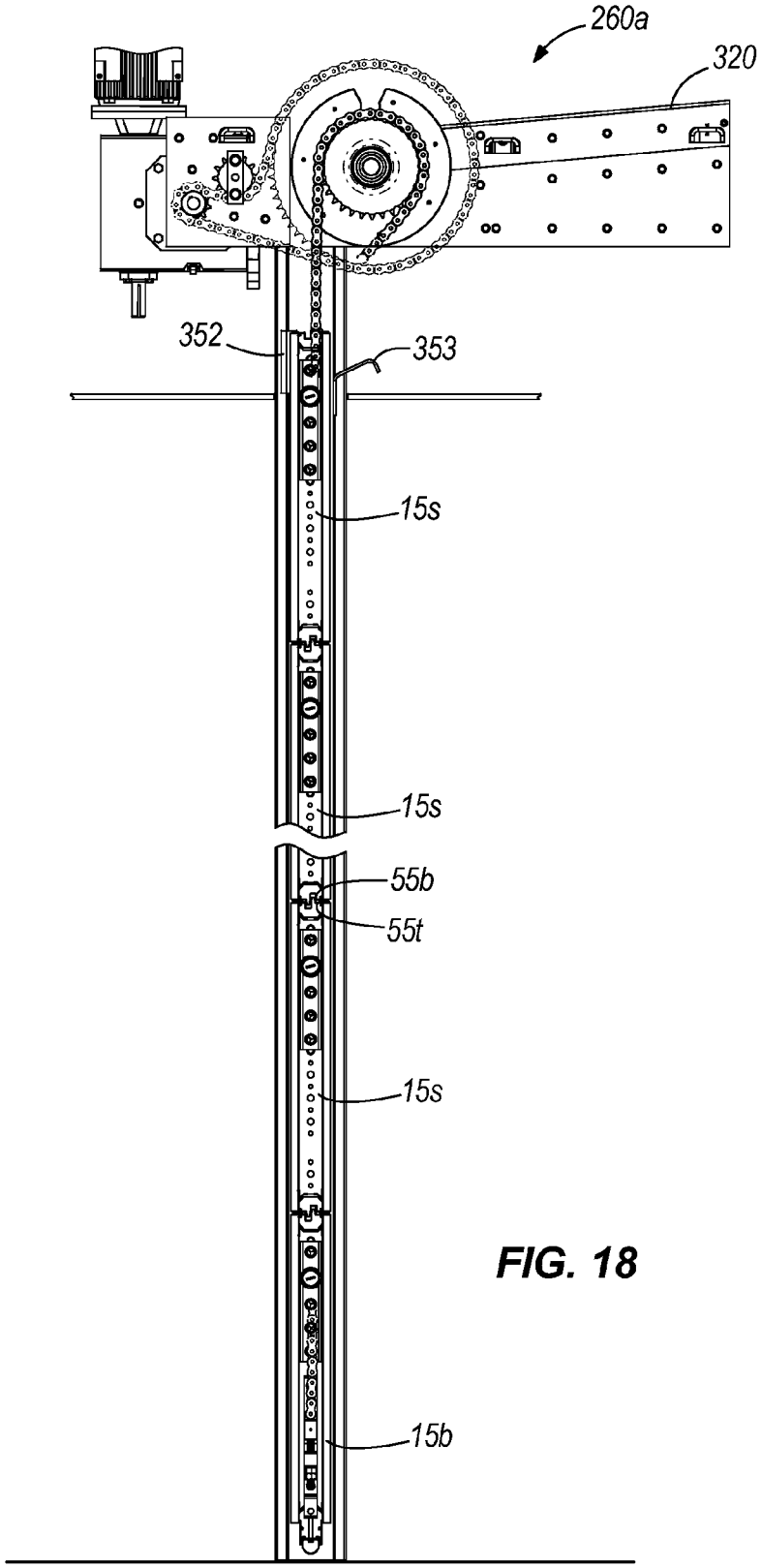
FIG. 18 is a side view of the panels in a deployed position.

In operation, the panels 15*b*, 15*s* are moved between a stowed position (shown in FIG. 11) to a deployed position (shown in FIG. 18). FIGS. 12-17 illustrate some of the steps of deploying the panels 15*b*, 15*s* and FIGS. 19-22 illustrate some of the steps of stowing the panels 15*b*, 15*s*.

In a stowed position, the stowable panels 15*s* are supported on the support racks 320 via the carriers 65. The support racks 320 bear the weight of the stowable panels 15*s* in the illustrated stowed position. The support racks 320 are inclined to bias the stowable panels 15*s* into engagement with the cams 295. In the illustrated stowed position, the bottom panel 15*b* is supported on the cams 295 via the carriers 65 in the slots 325. In the illustrated stowed position, the cams 295 bear the weight of the bottom panel 15*b* and the chains 315 bear little or none of the weight of the bottom panel 15*b*. In another embodiment, the bottom panel 15*b* is supported by the chains 315 in the stowed position. In still another embodiment, the bottom panel 15*b* is supported by the support racks 320 in the stowed position. In the stowed position, the bottom panel 15*b* is recessed above the ceiling 35 so that the seal 155 is recessed above the ceiling 35. In another embodiment, the seal 155 is level with the ceiling 35 when the wall panels 15 are stowed.

Operation of the motor 245 rotates the first and second outputs 265*a*, 265*b* of the gear reducer 250. The first and second outputs 265*a*, 265*b* of the gear reducer 250 cause rotation of the respective first and second output shafts 255*a*, 255*b*. The first and second output shafts 255*a*, 255*b* rotate respective first drive shafts 275, which thereby rotate the respective first sprockets 280. Rotation of the first sprockets 280 causes movement of the respective first chains 305, which causes rotation of the respective second sprockets 290 and thereby, rotation of the respective second drive shafts 285. The cams 295 and the third sprockets 300 are coupled for rotation with the respective second drive shafts 285. Therefore, the cams 295 rotate about the respective second drive shafts 285 in response to operation of the motor 245.

Figure 12:
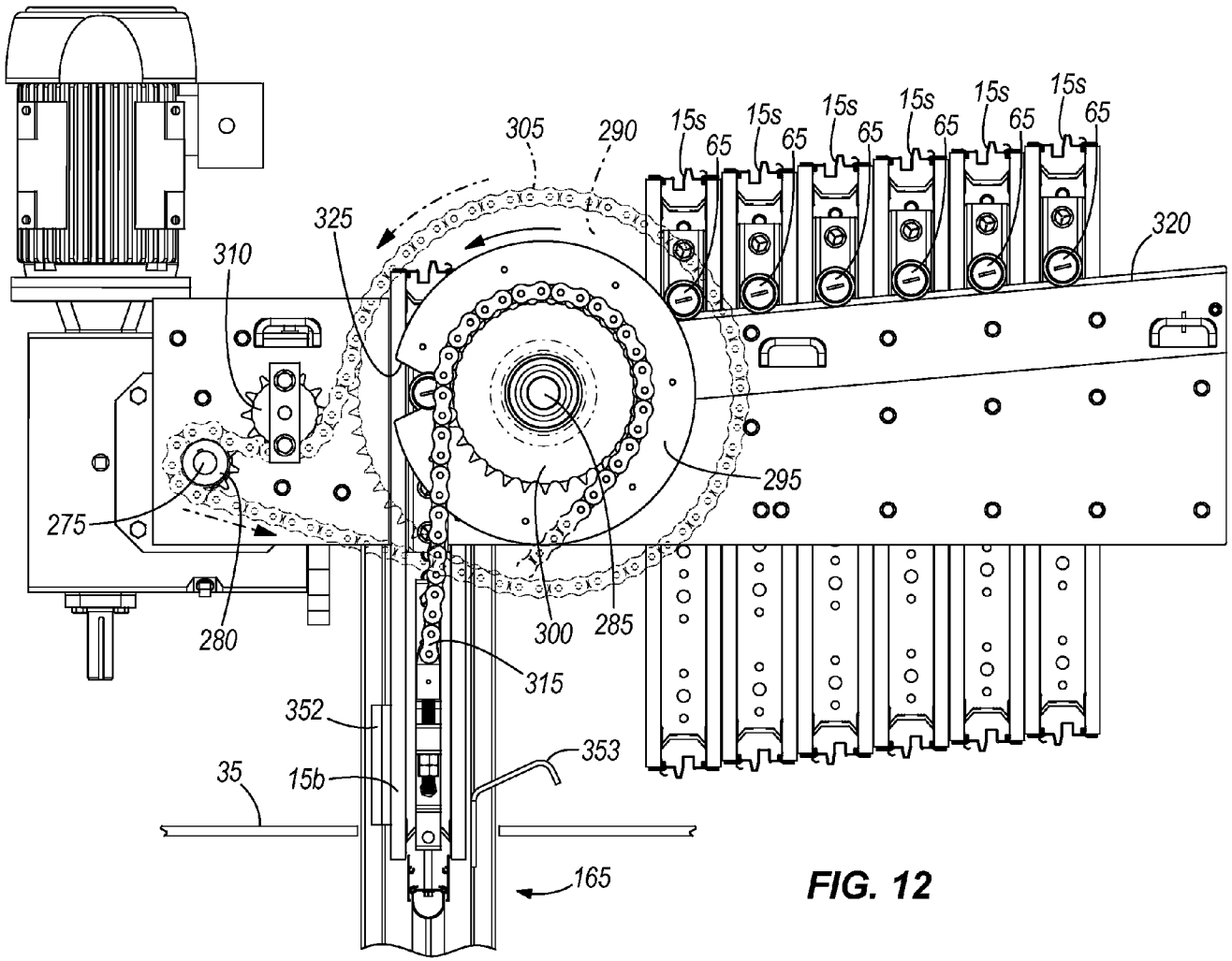
FIG. 12 is a side view illustrating the rotation of the cam to release the bottom panel from the cam.

To deploy the wall panels 15, the motor 245 causes the cams 295 to rotate to release the carriers 65 of the bottom panel 15*b* from the cam slots 325, to thereby lower the bottom panel 15*b* (see FIG. 12). When released from the cam slots 325, the chains 315 bear the weight of the bottom panel 15*b* through the chain mounts 165. As the second drive shafts 285 continue to rotate, the chains 315 continue to lower the bottom panel 15*b*. The first and second alignment brackets 352, 353 guide the bottom panel 15*b* to maintain the bottom panel 15*b* in a substantially vertical orientation.

Figure 13:
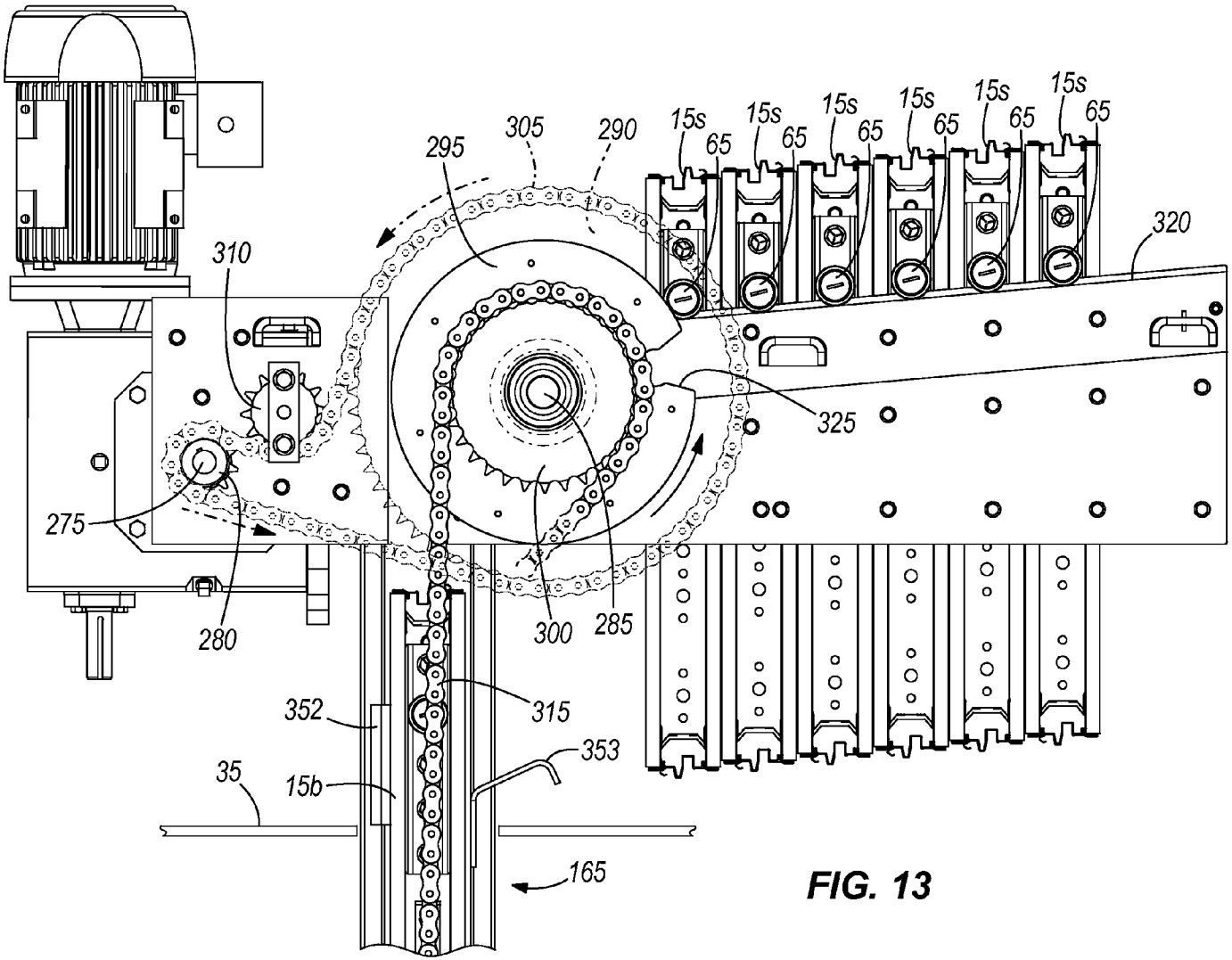
FIG. 13 is a side view illustrating the inclined support rack biasing the carrier of the first stowable panel against the cam.
Figure 14:
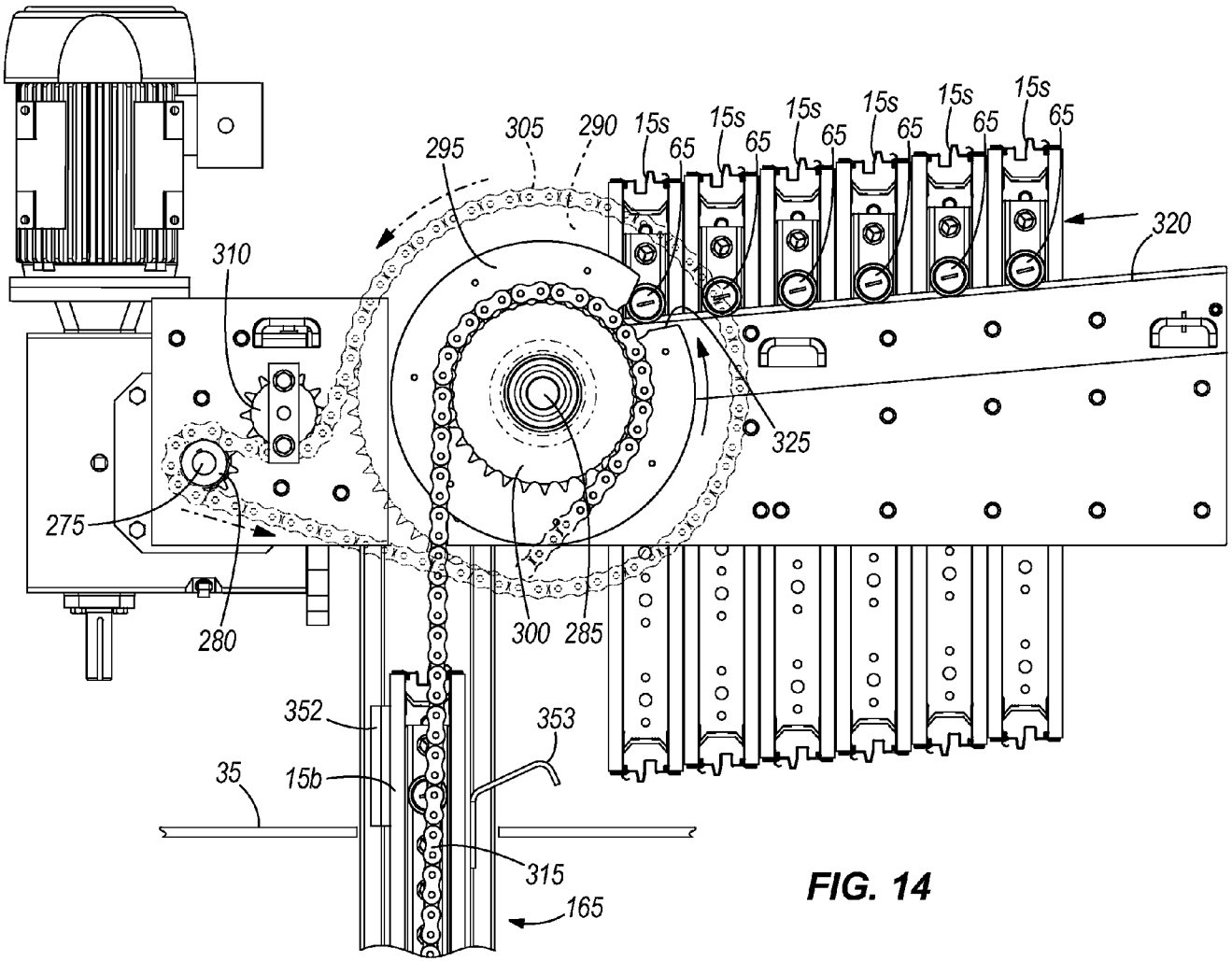
FIG. 14 is a side view illustrating the cam engaging the carrier of first stowable panel.

As shown in FIG. 13, the inclined support racks 320 bias the carriers 65 of the first stowable panel 15*s* against the respective cams 295. The carriers 65 abut the cams 295 as the cams 295 rotate in response to rotation of the second drive shafts 285. In the illustrated embodiment, the second bearings 125 ride along the outside surface of the cams 295. When the cam 295 slots are oriented to receive the carriers 65 of the first stowable panel 15*s*, the inclined support racks 320 bias the carriers 65 of the first stowable panel 15*s* into the cam slots 325 (see FIG. 14). The carriers 65 ride along the inclined support racks 320 into the recess portions 325*c*.

Figure 15:
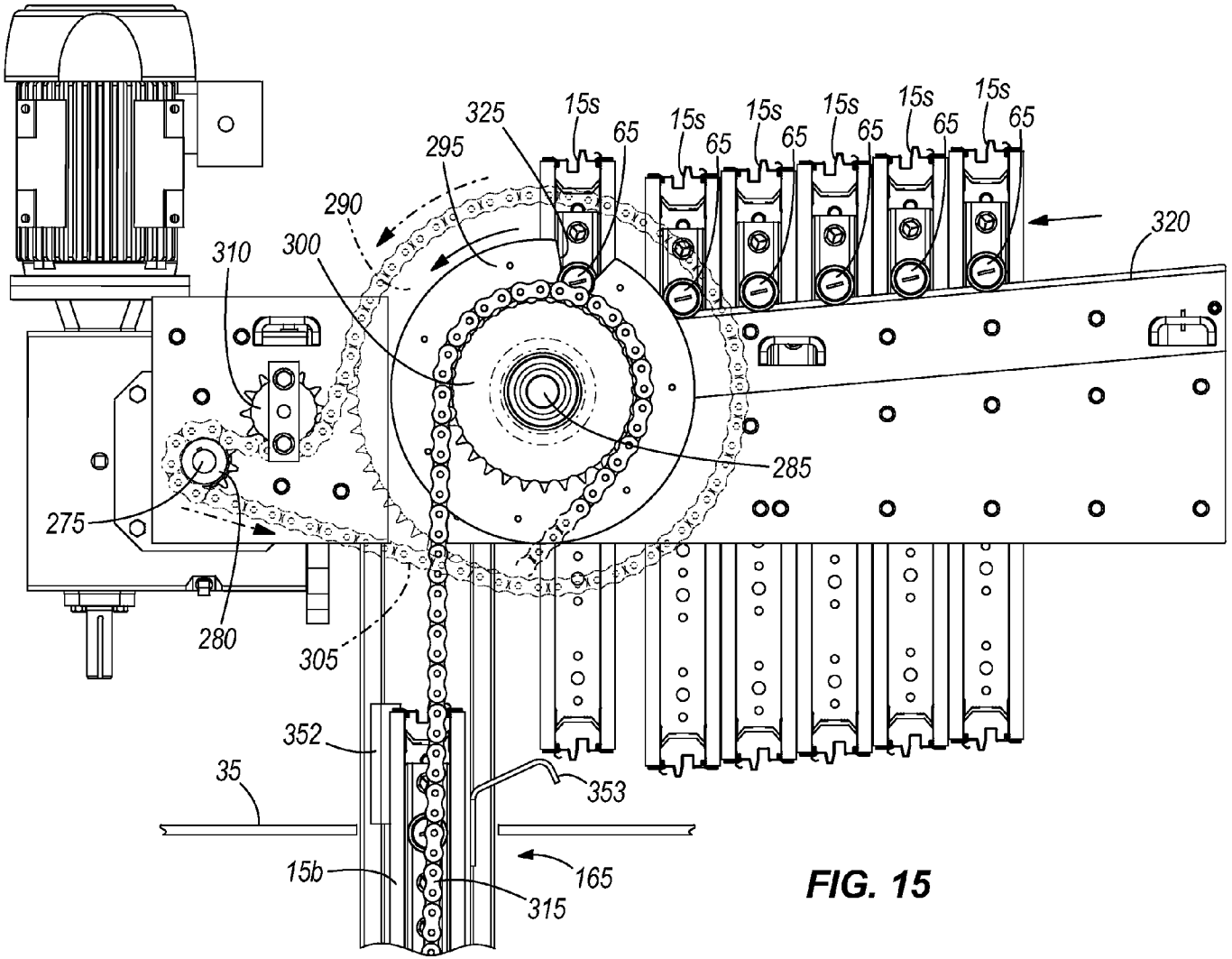
FIG. 15 is a side view illustrating the cam lifting the first stowable panel off of the inclined support rack.

With reference to FIG. 15, the cams 295 lift the first stowable panel 15*s* off of the inclined support racks 320, thereby transferring the weight of the first stowable panel 15*s* from the support racks 320 to the cams 295. In the illustrated embodiment, the cams 295 engage the first bearings 120 of the carriers 65. The recess portions 325*c* retain the carriers 65 until the cams 295 have rotated to a position in which the slots 325 are facing substantially horizontal, such as the position illustrated in FIG. 16.

In the illustrated embodiment, the recess portions 325*c* are sized to receive the carriers 65. In other embodiments, the recess portions 325*c* are larger than the carriers 65 and permit the carriers 65 to slide along the recess portions 325*c*. In these embodiments, the carriers 65 roll along the slots 325 when the slots are facing substantially vertically upward. The recess portions 325*c* define a length which is adjustable to accommodate tolerance requirements and to minimize noise when the carriers 65 move along and abut ends of the recess portions 325*c*.

Figure 16:
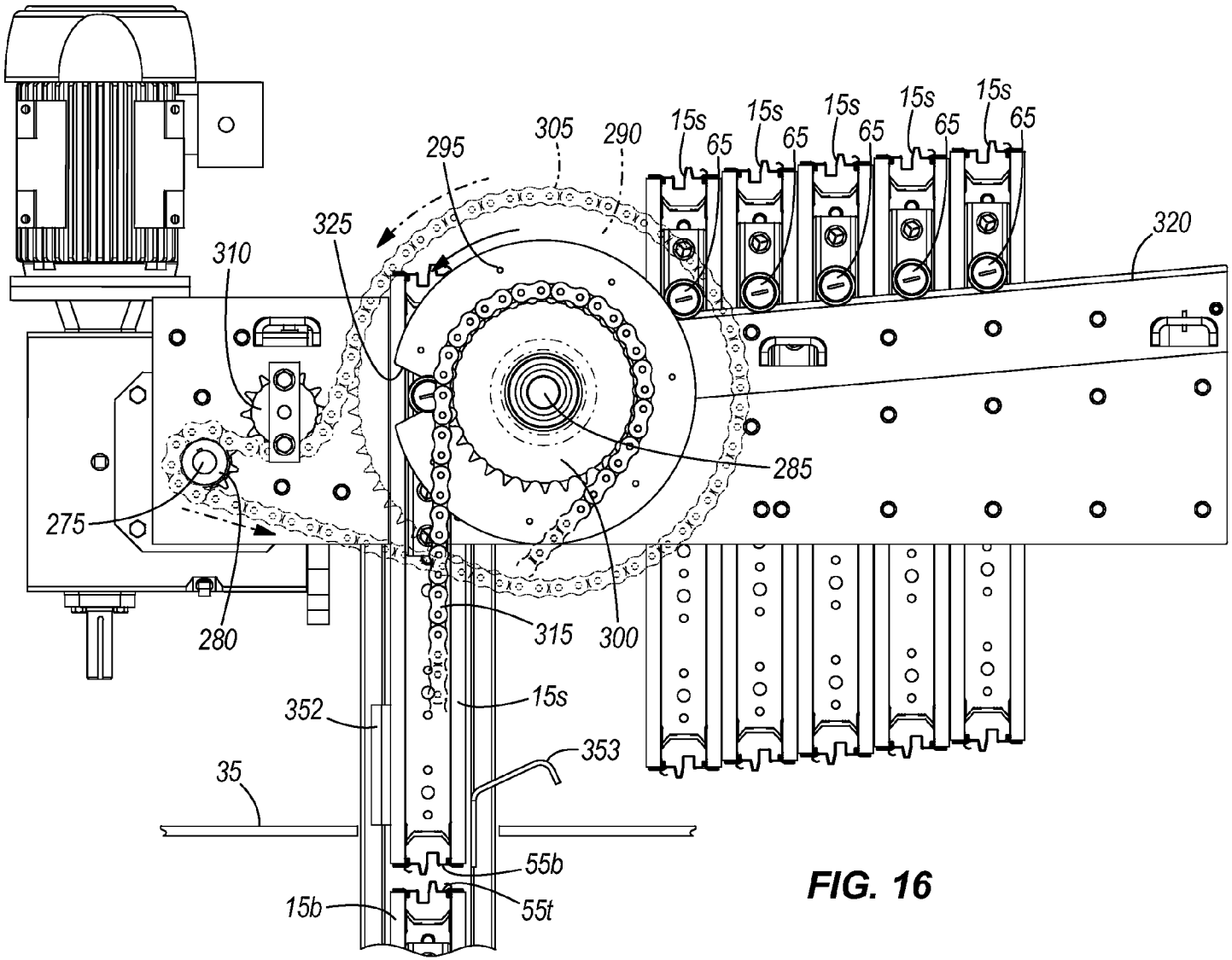
FIG. 16 is a side view illustrating the cam positioning the first stowable panel vertically above the bottom panel.

As shown in FIG. 16, the cams 295 continue to rotate in response to operation of the motor 245 to position the first stowable panel 15*s* substantially vertically above the bottom panel 15*b*. The first and second alignment brackets 352, 353 guide the first stowable panel 15*s* into vertically alignment with the bottom panel 15*b*. The cams 295 continue to lower the first stowable panel 15*s* onto the bottom panel 15*b*, such that the mating dovetail pieces 55*t*, 55*b* on a top of the bottom panel 15*b* and on a bottom of the first stowable panel 15*s* engage. As shown in FIG. 17, the cams 295 release the first stowable panel 15*s* and the chains 315 support the first stowable panel 15*s* in response to the connection between the first bottom panel 15*b* and the chains 315. The first stowable panel

15*s* is not connected to the chains 315, except for the indirect connection through the first bottom panel 15*b*.

With continued reference to FIG. 17, the first and second jamb assemblies 25*a*, 25*b*, specifically the first and second alignment brackets 352, 353, orient the first stowable panel 15*s* above the bottom panel 15*b* to guide the dovetails 55*t*, 55*b* into mating engagement when the cams 295 release the first stowable panel 15*s*. The first and second jamb assemblies 25*a*, 25*b* are fixed to the respective first and second drive box assemblies 260*a*, 260*b* and to the floor. The first and second alignment brackets 352, 353 guide and vertically align the panels 15*b*, 15*s* during deployment and stowage. The carriers 65 move within the internal guidance system 335 of the first and second jamb assemblies 25*a*, 25*b*.

The remaining stowable panels 15*s* are deployed in the same manor as the first stowable panel 15*s* is deployed. The stowable panels 15*s* rest on top of other stowable panels 15*s* and the bottom panel 15*b* when deployed. The top dovetail piece 55*t* of one panel mates with the bottom dovetail piece 55*b* of the panel above it, when the wall panel assembly 10 is deployed. The chains 315 bear the weight of all of the deployed panels 15 via the connection between the chains 315 and the bottom panel 15*b*. FIG. 18 is a perspective view of the panels 15*b*, 15*s* in a deployed position in which all of the stowable panels 15*s* are positioned on the bottom panel 15*b*. In the illustrated embodiment, the top panel 15*s* extends through the opening 40 above the ceiling 35. In another embodiment, a top of the top panel 15*s* is substantially level with the opening 40. The mating dovetail pieces 55*t*, 55*b* of the stowable panels 15*s* engage to substantially fix the adjacent deployed panels 15*b*, 15*s* together. The weight of the stowable panels 15*s*, the mating dovetail pieces 55*t*, 55*b* and the first and second jamb assemblies 25*a*, 25*b*, in combination, retain the wall panels 15 in a substantially vertical position when deployed. The front and rear panel faces 50*f*, 50*r* of the wall panels 15 together provide a substantially continuous wall surface when the wall panel assembly 10 is deployed.

Figure 19:
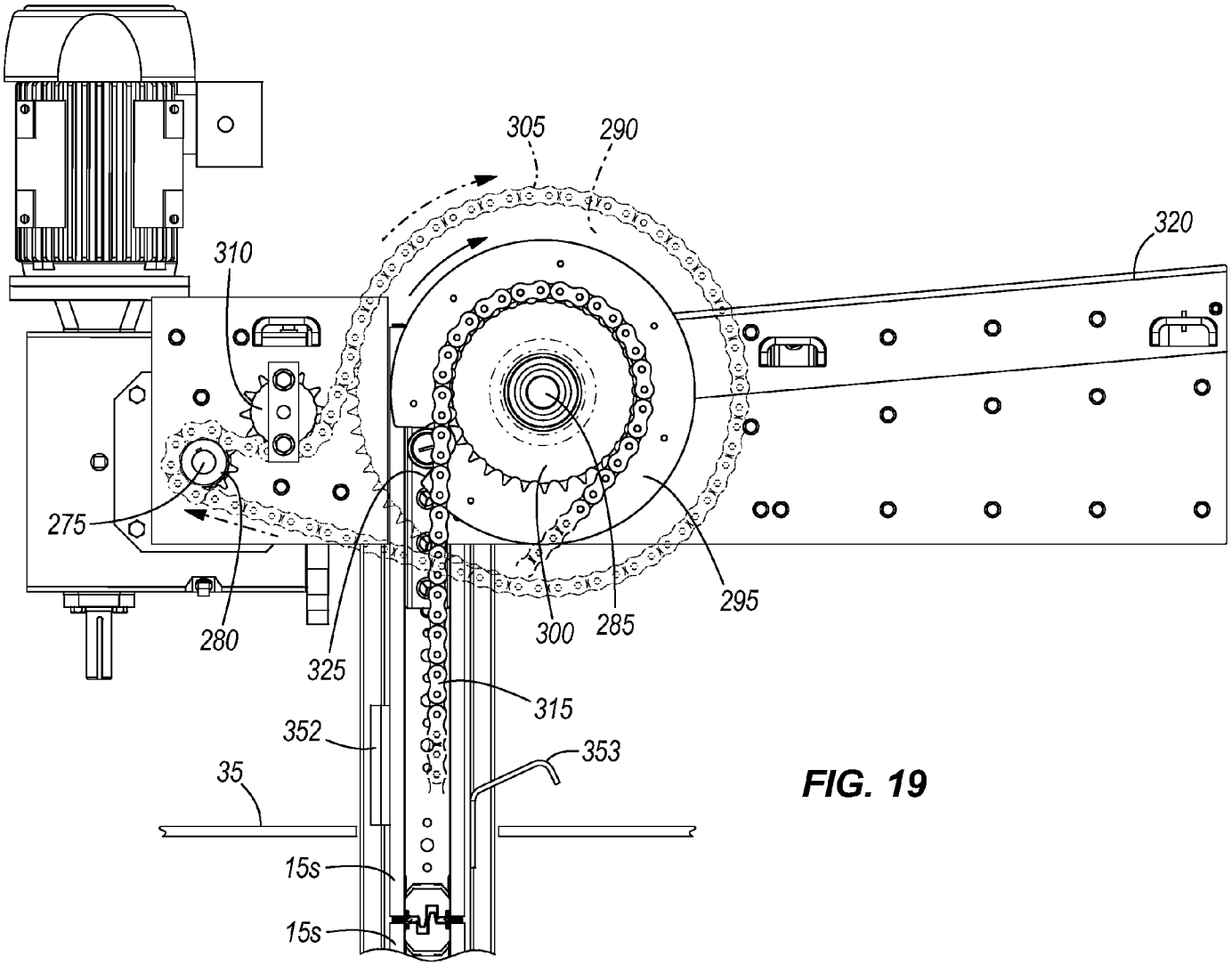
FIG. 19 is a side view illustrating the cam engaging the carrier of the top panel.
Figure 20:
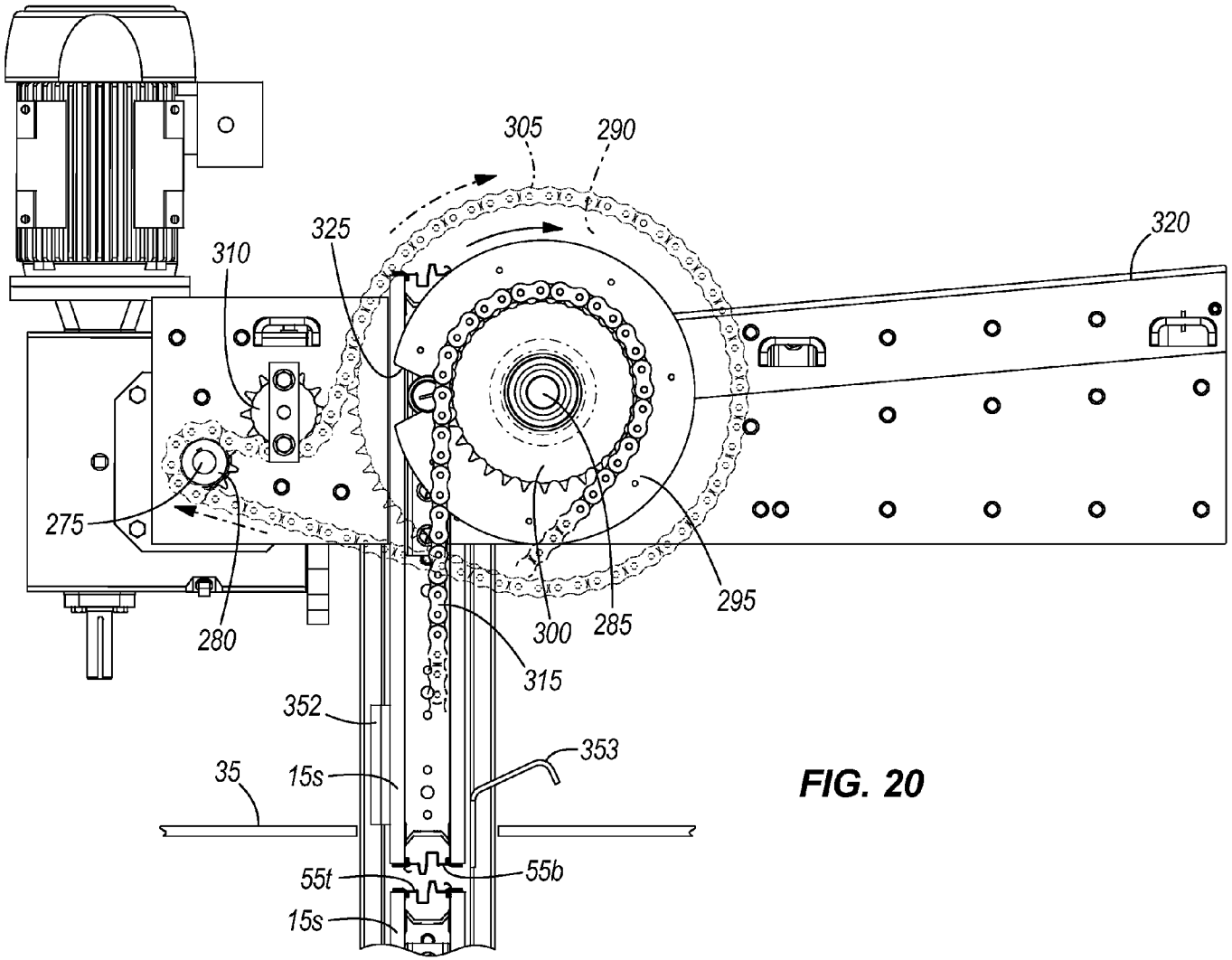
FIG. 20 is a side view illustrating the cam vertically displacing the top panel off of the remaining panels.

To stow the panels 15, the motor 245 operates in an opposite direction of that of deployment. Operation of the motor 245 rotates the cams 295 in the opposite direction. With reference to FIG. 19, the cams 295 engage the carriers 65 of the top panel 15*s*. In response to rotation of the cams 295, the cams 295 lift the top panel 15*s* off of the other panels 15*s*, 15*b*, as shown in FIG. 20. The top panel 15*s* is first vertically displaced from the remaining panels 15*s*, 15*b* in response to rotation of the cams 295. The top panel 15*s* is then horizontally displaces from the remaining panels 15*s*, 15*b* in response to further rotation of the cams 295, as shown in FIG. 21.

Figure 21:
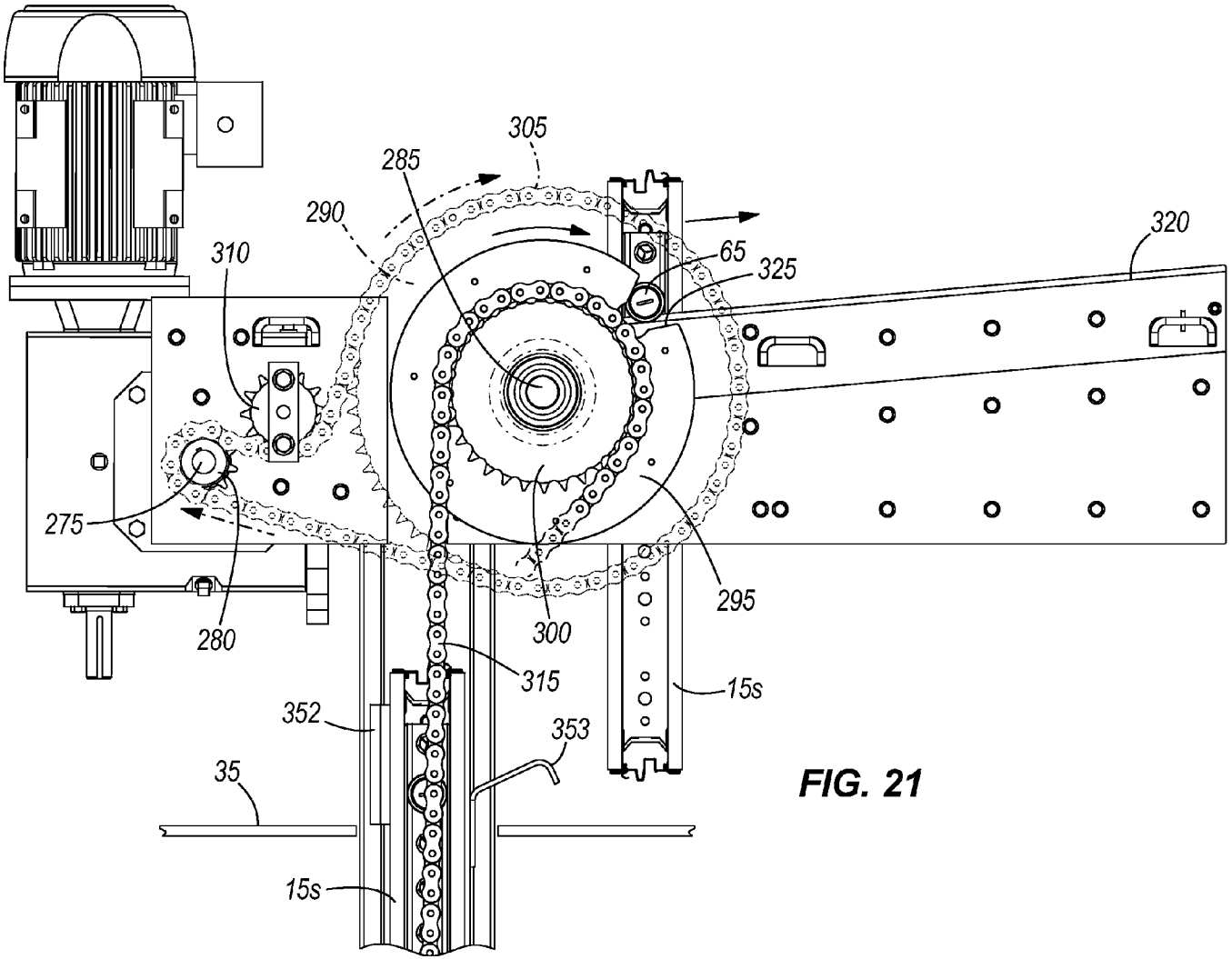
FIG. 21 is a side view illustrating the cam horizontally displacing the top panel with respect to the remaining panels as the cam transfers top panel onto the inclined support rack.
Figure 22:
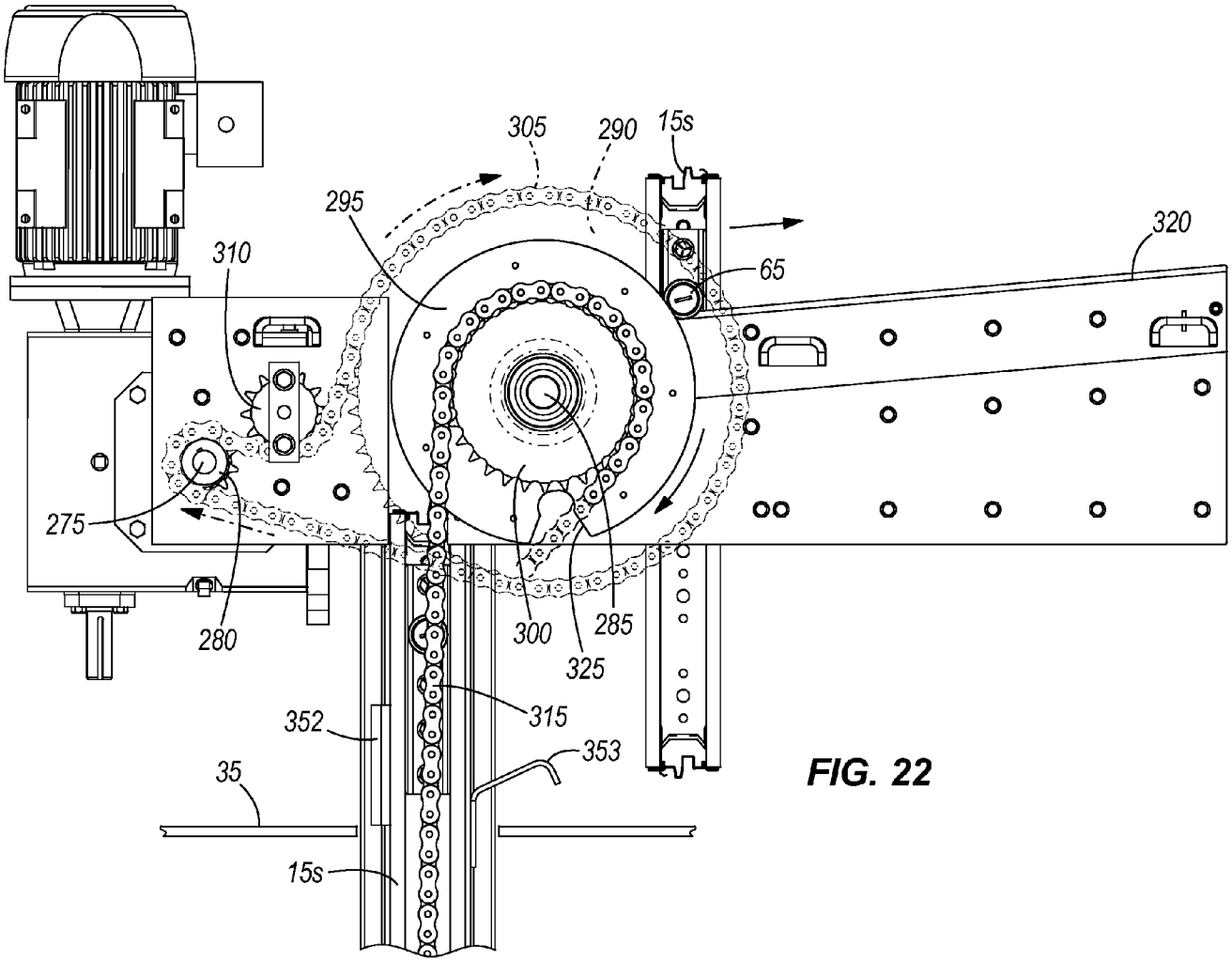
FIG. 22 is a side view illustrating the chain further lifting the remaining panels as the cam slot approaches the carrier of the next panel.

FIG. 21 also illustrates that the chains 315 continue to lift the remaining panels 15*s*, 15*b* as the cams 295 transfer the top panel 15*s* onto the inclined support rack 320. The top panel 15*s* is urged up the inclined support rack 320 by the second substantially planar portion 325*a*. As shown in FIG. 22, the chains 315 further lift the remaining panels 15*s*, 15*b* as the cam 295 slots approach the carriers 65 of the next panel. In the illustrated embodiment, one full rotation of the cam 295 occurs per stowing or deploying of one panel 15. The illustrated third sprocket 300 has an outside perimeter that equals the height of the panels 15. The illustrated cams 295 have a larger diameter than the third sprockets 300 so that the cams 295 lift the panel 15*s* off of the remaining panels 15*s*, 15*b* while stowing and lowers the panel 15*s* vertically onto the remaining panels 15*s*, 15*b* while deploying. This lifting and lowering permits vertical alignment of the mating dovetail protrusions 55*t*, 55*b* prior to mating engagement of the mating dovetail protrusions 55*t*, 55*b*.

Various features and advantages of the invention are set forth in the following claims.

What is claimed is:

1. A method of moving panels from a stowed position, in which the panels are substantially positioned above a ceiling, to a deployed position, in which the panels are substantially vertically aligned to form a wall, the method comprising:

supporting a first panel on a cam, the first panel having a first weight;

rotating the cam in a first direction;

lowering the first panel in response to rotation of the cam, wherein lowering the first panel separates the first panel from the cam;

supporting the first panel on a flexible lift member in response to lowering the first panel, wherein the flexible lift member bears the first weight;

supporting a second panel on a support rack, the second panel having a second weight;

biasing the second panel into engagement with the cam;

rotating the cam in the first direction;

transferring the second panel from the support rack to the cam in response to rotating the cam, wherein the cam bears the second weight;

further rotating the cam in the first direction;

lowering the second panel in response to further rotation of the cam;

transferring the second panel from the cam to the first panel, wherein the first panel bears the second weight, and wherein the flexible lift member bears the first weight and the second weight through the connection between the first panel and the flexible lift member; and fixing the second panel to the first panel through a mating tongue and groove engagement.

2. The method of claim 1, further comprising supporting a third panel on the support rack, wherein the third panel has a third weight;

biasing the third panel into engagement with the cam;

rotating the cam in the first direction;

transferring the third panel from the support rack to the cam in response to rotating the cam, wherein the cam bears the third weight;

further rotating the cam;

lowering the third panel in response to further rotation of the cam;

transferring the third panel from the cam to the first and second panels, wherein the first panel bears the second weight and the third weight, and wherein the flexible lift member bears the first, second and third weights through the connection between the first panel and the flexible lift member; and fixing the third panel to the second panel through a mating tongue and groove engagement.

3. The method of claim 2, wherein the cam rotates approximately 360 degrees between transferring the second panel from the support rack to the cam and transferring the third panel from the support rack to the cam.

4. The method of claim 1, wherein moving the second panel into engagement with the cam includes inclining the support rack at a non-horizontal angle, and moving the second panel into engagement with the cam under the influence of gravity.

5. The method of claim 1, further comprising guiding the first panel to retain the first panel in a substantially vertical orientation while lowering the first panel.

6. A method of moving panels from a deployed position, in which the panels are substantially vertically aligned to form a wall, to a stowed position, in which the panels are substantially positioned above a ceiling, the method comprising:

supporting a first panel on a flexible lift member, the first panel having a first weight, wherein the flexible lift member bears the first weight;

supporting a second panel on the first panel, the second panel having a second weight, wherein the flexible lift member bears the first weight and the second weight through the connection between the first panel and the flexible lift member;

moving the first and second panels substantially vertically;

lifting the second panel off of the first panel with a cam, wherein the cam bears the second weight;

disengaging the second panel from the first panel by vertically displacing the second panel from the first panel;

transferring the second panel from the cam to a support rack, wherein the support rack bears the second weight;

displacing the second panel horizontally from the first panel by transferring the second panel onto the support rack;

further moving the first panel substantially vertically;

lifting the first panel with the cam; and rotating the cam such that the cam bears the first weight.

7. The method of claim 6, further comprising supporting a third panel on the second panel, the third panel having a third weight, wherein the third weight is supported by the flexible lift member through the connection between the flexible lift member and the first panel;

lifting the third panel off of the second panel with the cam, wherein the cam bears the third weight;

disengaging the third panel from the second panel by vertically displacing the third panel from the second panel;

transferring the third panel from the cam to the support rack, wherein the support rack bears the third weight, wherein the third panel is lifted and transferred prior to lifting and transferring the second panel; and displacing the third panel horizontally from the second panel by transferring the third panel onto the support rack.

8. The method of claim 7, wherein the cam rotates approximate 360 degrees between lifting the third panel with the cam and lifting the second panel with the cam.

9. The method of claim 7, further comprising biasing the third panel up an incline in response to transferring the second panel from the cam to the support rack.

10. The method of claim 6, further comprising guiding the first panel to retain the first panel in a substantially vertical orientation while moving the first panel vertically.

11. A wall panel assembly moveable between a stowed position and a deployed position, the wall panel assembly comprising:

a first wall panel having a first weight and including a first carrier;

a flexible lift member coupled to the first wall panel;

a second wall panel having a second weight and including a second carrier;

a prime mover operable to move the first and second wall panels between the stowed position and the deployed position;

a support rack, wherein the support rack supports the second carrier and bears the second weight when the second wall panel is in the stowed position, and wherein the flexible lift member bears the second weight when the second wall panel is in the deployed position through the connection between the first wall panel and the flexible lift member; and a cam having an exterior perimeter defining a recess, the recess sized to receive at least one of the first and second carriers, the cam being rotatable in response to the prime mover, wherein rotation of the cam in a first direction moves the first and second wall panels into the deployed position, and wherein rotation of the cam in a second direction, opposite the first direction, moves the first and second wall panels into the stowed position.

12. The wall panel assembly of claim 11, further comprising a third wall panel having a third weight and including a third carrier, wherein the support rack supports the third carrier and bears the third weight when the third wall panel is in the stowed position, and wherein the flexible lift member bears the third weight when the third wall panel is in the deployed position through the connection between the first wall panel and the flexible lift member.

13. The wall panel assembly of claim 11, wherein the cam rotates approximate 360 degrees between receiving the first carrier and receiving the second carrier.

14. The wall panel assembly of claim 13, further comprising a sprocket coupled to the cam, wherein the cam has a first diameter and the sprocket has a second diameter, less than the first diameter.

15. The wall panel assembly of claim 11, wherein the support rack includes a non-horizontal incline, and wherein the second carrier moves down the incline under the influence of gravity into engagement with the cam when the second wall panel is in the stowed position.

16. The wall panel assembly of claim 11, wherein the cam recess is substantially symmetrical, wherein the cam recess includes a first portion for transferring the second wall panel from the support rack to the cam and a second portion for transferring the second wall panel from the first wall panel to the cam.

17. The wall panel assembly of claim 11, further comprising a jamb sized to receive the first and second carriers when the flexible lift member bears the first and second weights, wherein the jamb at least partially surrounds the first and second carriers to retain the first and second wall panels in a substantially vertical orientation.

18. The wall panel assembly of claim 11, wherein the first carrier comprises a shaft, a head, and at least one bearing, wherein the at least one bearing engages the support rack when the first wall panel is stowed and engages the cam when the first wall panel is moved between the stowed and deployed positions.

19. The wall panel assembly of claim 11, wherein the first wall panel is connected to the flexible lift member and the second wall panel is connected to the flexible lift member indirectly through the first wall panel.

20. The wall panel assembly of claim 11, wherein the flexible lift member is a chain.

* * * * *